US008426717B2

(12) United States Patent
Okuyama et al.

(10) Patent No.: US 8,426,717 B2
(45) Date of Patent: Apr. 23, 2013

(54) DISCRIMINATOR FOR DISCRIMINATING EMPLOYED MODULATION TECHNIQUE, SIGNAL DEMODULATOR, MUSICAL INSTRUMENT AND METHOD OF DISCRIMINATION

(75) Inventors: Fukutaro Okuyama, Hamamatsu (JP); Shigekazu Hirabayashi, Mino (JP)

(73) Assignee: Yamaha Corporation, Shizuoka-Ken (JP)

( * ) Notice: Subject to any disclaimer, the term of this patent is extended or adjusted under 35 U.S.C. 154(b) by 799 days.

(21) Appl. No.: 12/636,876

(22) Filed: Dec. 14, 2009

(65) Prior Publication Data

US 2010/0161341 A1 Jun. 24, 2010

(30) Foreign Application Priority Data

Dec. 19, 2008 (JP) ..... 2008-323825

(51) Int. Cl.
*G10H 1/00* (2006.01)

(52) U.S. Cl.
USPC ..... 84/624; 84/659; 332/103; 329/304

(58) Field of Classification Search ..... 84/624, 84/659; 332/103–105, 108; 329/304, 305, 329/310, 345, 346
See application file for complete search history.

(56) References Cited

U.S. PATENT DOCUMENTS 3,990,011 A * 11/1976 Knight ..... 455/226.4
4,041,406 A * 8/1977 Hanewinkel ..... 329/303
4,160,955 A * 7/1979 Sato ..... 329/317
4,575,684 A * 3/1986 Stamm ..... 329/307
4,819,253 A * 4/1989 Petruschka ..... 375/249
4,841,470 A * 6/1989 Okamoto et al. ..... 708/815
4,896,336 A * 1/1990 Henely et al. ..... 375/324
4,975,654 A * 12/1990 Becker et al. ..... 329/347
6,970,517 B2 11/2005 Ishii
7,110,677 B2 * 9/2006 Reingand et al. ..... 398/98
7,133,462 B2 * 11/2006 Ha et al. ..... 375/295
7,477,707 B2 * 1/2009 Kazi et al. ..... 375/330
8,237,494 B2 * 8/2012 Bouillet et al. ..... 329/304
8,249,198 B2 * 8/2012 Tsuwa ..... 375/330
2003/0058499 A1 * 3/2003 Reingand et al. ..... 359/135
2005/0008101 A1 * 1/2005 Kazi et al. ..... 375/330
2007/0177151 A1 * 8/2007 Isomura et al. ..... 356/477
2007/0230620 A1 * 10/2007 Poberezhskiy ..... 375/308
2008/0226295 A1 * 9/2008 Miura et al. ..... 398/79
2008/0273644 A1 * 11/2008 Chesnutt et al. ..... 375/370
2010/0161341 A1 * 6/2010 Okuyama et al. ..... 704/500
2010/0189437 A1 * 7/2010 Hoshida ..... 398/65
2011/0074500 A1 * 3/2011 Bouillet et al. ..... 329/347

* cited by examiner

*Primary Examiner* — David S. Warren
(74) *Attorney, Agent, or Firm* — Harness, Dickey & Pierce, PLC

(57) ABSTRACT

A signal modulator includes a discriminator for discriminating a modulation technique through which a carrier signal was modulated to a quasi audio signal and a signal demodulation module for reproducing a continuous data stream from the quasi audio signal through a demodulating technique corresponding to the discriminated modulation technique; the discriminator includes a sampling circuit for extracting groups of samples from the quasi audio signal during each period of the carrier signal, an integrator calculating an integrated value on each group of samples, a comparator comparing the integrated value with a threshold for a neighborhood of zero so as to determine the groups of samples with the integrated value less than the threshold and a determiner measuring the time period between the groups of two modulation period and discriminating 16DPSK when the time period is equal to the modulation period.

20 Claims, 11 Drawing Sheets

DISCRIMINATOR FOR DISCRIMINATING EMPLOYED MODULATION TECHNIQUE, SIGNAL DEMODULATOR, MUSICAL INSTRUMENT AND METHOD OF DISCRIMINATION

FIELD OF THE INVENTION

This invention relates to modulated signal discrimination techniques and, more particularly, to a signal discriminator for discriminating a modulation technique in which an input signal was modulated, a signal demodulating system equipped with the signal discriminator, an automatic player musical instrument provided with the signal demodulating system and a method employed in the signal demodulator.

DESCRIPTION OF THE RELATED ART

The MIDI (Musical Instrument Digital Interface) protocols are popular to music players and music composers. While a music player is performing a keyboard musical instrument equipped with a MIDI code generator, the movements of keys are converted to music data codes in accordance with the MIDI protocols, and the music data codes are supplied to the electronic tone generator. The electronic tone generator has a waveform memory, and the pieces of waveform data are read out from the waveform memory for producing an audio signal. The audio signal is supplied to a sound system, and electronic tones are produced from the audio signal through the sound system. If the keyboard musical instrument has a recording system, the music data codes are transferred to the recording system, and are stored in a suitable information storage medium as a MIDI music data file. In this instance, the music data codes are stored in the MIDI music data file in their original bit strings. In other words, the music data codes are not subjected to any signal modulation.

Another recording and reproducing system is known to persons skilled in the art. The prior art recording and reproducing system comprises a recording section and a reproducing section, and the recording section includes a converting module, a modulating module and a recording module, and these modules behave as follows.

While a music player is performing a music tune on the musical instrument, the music data codes are asynchronously produced in the MIDI code generator, and are supplied to the recording section. Time intervals take place between asynchronously produced music data codes. The converting module makes up the time intervals with synchronous nibble code or synchronous nibble codes, and outputs a nibble stream, i.e., a continuous data stream of music data codes and synchronous nibble codes. The continuous data stream is supplied to the modulating module.

A carrier signal of the audio frequency band is modulated with the continuous data stream. The continuous data stream is divided into 4-bit codes, each of which is referred to as "a symbol", in the modulation module, and the carrier signal is modulated with each of the symbols. The carrier frequency is 6.30 kHz, and the symbol transmission velocity is 3.15 kbaud (kilo-symbol/sec). The modulated signal is supplied to the recording module.

In the recording module, the modulated signal is subjected to the pulse-code-modulation so that the modulated signal is converted to a digital audio signal. The digital audio signal is stored in a channel of the compact disk. An external audio signal may be stored in the other channel of the compact disk.

When a user wishes a playback, the digital audio signal is read out from the compact disk, and is converted to the audio signal. The audio signal is demodulated to the continuous data stream, and the synchronous nibbles are removed from the continuous data stream. In this way, the music data codes are recovered from the continuous data stream, and the original performance is reenacted through a suitable musical instrument with the electronic tone generator and sound system on the basis of the music data codes.

However, various manufacturers employ different modulation techniques in the modulating modules. A manufacturer employs a 16 DPSK (Differential Phase-Shift Keying) in the modulating module, and another manufacturer employs a binary FSK (Frequency Shift Keying) in the modulating module. Yet another manufacturer designs the modulating module on the basis of another sort of binary FSK different from the binary FSK employed by the manufacturer.

In this situation, a signal discriminator is required for the demodulating module of the reproducing section. A signal discriminator is disclosed in Japan Patent Application laid-open No. 2002-94593, which is corresponding to Japan Patent Application No. 2000-363725. U.S. patent application Ser. No. 09/900,067 was filed on the basis of the Japan Patent Application under the benefit of the Convention Priority, and was patented as U.S. Pat. No. 6,970,517 B2.

The principle of the prior art signal discriminator is based on the fact that the analog audio signal, which is converted from the digital audio signal, has different values of edge-to-edge intervals depending upon the modulation technique employed in the modulating modules. For example, a prior art recording and reproducing system, in which the 16DPSK is employed, produces the analog audio signal, the edge-to-edge intervals of which are 317.5×n μs. (n is a positive number). Another prior art recording and reproducing system, which is equipped with the binary FSK, produces the analog audio signal, the edge-to-edge intervals of which are selected from the group of 145 μs, 290 μs, 581 μs and 3855 μs, and yet another recording and reproducing system, which is equipped with another sort of binary FSK, produces the analog audio signal, the edge-to-edge intervals of which are either 259 μs or 129.5 μs. Thus, although the converting module and recording module are common to the prior art recording and reproducing systems, the edge-to-edge intervals of digital audio signal are different from one another depending upon the modulating techniques employed in the modulating modules.

The prior art signal discriminator disclosed in the Japan Patent Application laid-open examines the analog audio signal for determining the edge-to-edge intervals of analog audio signal, and presumes the employed modulation technique on the basis of the value of edge-to-edge intervals. The prior art signal discriminator notifies the demodulator of the presumed modulation technique for selecting a proper demodulating technique from the candidates. The prior art signal discriminator determines the edge-to-edge intervals on the basis of the zero-crossing points of the analog audio signal.

A problem is encountered in the prior art recording and reproducing system in the reliability of the signal discriminator.

Another problem is that the prior art signal discriminator sometimes fails to discriminate the edge-to-edge intervals.

SUMMARY OF THE INVENTION

It is therefore an important object of the present invention to provide a highly reliable discriminator for employed modulation technique.

It is also an important object of the present invention to provide a signal demodulator, which is equipped with the discriminator.

It is another important object of the present invention to provide an automatic player musical instrument, in which the demodulator is incorporated.

It is yet another important object of the present invention to provide a method of discrimination which is employed in the discriminator.

The present inventors contemplated the problem, and noticed that the intervals of zero-crossing points did not exactly express the edge-to-edge intervals of the analog audio signal due to noise.

The present inventors further noticed that the failure took place on the condition that the tone has the pitch of 6.3 kHz. The present inventors found that the prior art signal discriminator confused the analog audio signal with the tone per se. The present inventors concluded that the problems were inherent in the prior art signal discriminating technique, and studied the modulating techniques for a new discriminating principle.

To accomplish the object, the present invention proposes to make a decision on the basis of a time period from a non-modulated section of a portion of a modulated signal to the non-modulated section of the next portion.

In accordance with one aspect of the present invention, there is provided a discriminator of a modulation technique through which a carrier signal is modulated to a modulated signal, the modulated signal is dividable into plural portions each equal in time period to a modulation period, each of the plural portions has a modulated section subjected to a modulation through the modulation technique and followed by a non-modulated section, the discriminator comprises an information processor having information processing capability and a sampler extracting discrete values from a waveform of the modulated signal so as to produce a series of samples expressing the discrete values and supplying the series of samples to the information processor, and a computer program runs on the information processor so as to realize a detector supplied with the series of samples from the sampler and specifying groups of samples expressing the non-modulated sections in the plural portions, a measurer supplied with the groups of samples from the detector and determining a time period between the group of samples in one of the plural portions and the group of samples in another of the plural portions next to the aforesaid one of the plural portions and a determiner determining that the modulation technique is same as a predetermined modulation technique when the time period is equal to the modulation period.

In accordance with another aspect of the present invention, there is provided a signal demodulator for reproducing a signal from a modulated signal, a carrier signal is modulated to the modulated signal with the signal through a modulation technique, the signal modulator comprises a discriminator supplied with the modulated signal dividable into plural portions each equal in time period to a modulation period, each of the plural portions has a modulated section subjected to a modulation through the modulation technique and followed by a non-modulated section, the discriminator includes an information processor having information processing capability and a sampler extracting discrete values from a waveform of the modulated signal so as to produce a series of samples expressing the discrete values and supplying the series of samples to the information processor, a computer program runs on the information processor so as to realize a detector supplied with the series of samples from the sampler and specifying groups of samples expressing the non-modulated sections in the plural portions, a measurer supplied with the groups of samples from the detector and determining a time period between the group of samples in one of the plural portions and the group of samples in another of the plural portions next to the aforesaid one of the plural portions and a determiner determining that the modulation technique is same as a predetermined modulation technique when the time period is equal to the modulation period, and the signal modulator further comprises a signal demodulating module connected to the discriminator and supplied with the modulated signal so as to demodulate the modulated signal to the signal through a demodulating technique corresponding to the predetermined modulation technique when the determiner determines that the modulation technique is same as the predetermined modulation technique.

In accordance with yet another aspect of the present invention, there is provided a musical instrument for producing tones comprising a signal demodulator for reproducing a music signal expressing tones to be produced from a modulated signal, a carrier signal is modulated to the modulated signal with the music signal through a modulation technique, and the signal demodulator includes a discriminator supplied with the modulated signal dividable into plural portions each equal in time period to a modulation period, each of the plural portions has a modulated section subjected to a modulation through the modulation technique and followed by a non-modulated section, the discriminator has an information processor having information processing capability and a sampler extracting discrete values from a waveform of the modulated signal so as to produce a series of samples expressing the discrete values and supplying the series of samples to the information processor, a computer program runs on the information processor so as to realize a detector supplied with the series of samples from the sampler and specifying groups of samples expressing the non-modulated sections in the plural portions, a measurer supplied with the groups of samples from the detector and determining a time period between the group of samples in one of the plural portions and the group of samples in another of the plural portions next to the aforesaid one of the plural portions and a determiner determining that the modulation technique is same as a predetermined modulation technique when the time period is equal to the modulation period, the signal modulator further includes a signal demodulating module connected to the discriminator and supplied with the modulated signal so as to demodulate the modulated signal to the music signal through a demodulating technique corresponding to the predetermined modulation technique when the determiner determines that the modulation technique is same as the predetermined modulation technique, and the musical instrument further comprises a tone generator connected to the signal modulator and supplied with the music signal so as to produce the tones on the basis of the music signal.

In accordance with still another aspect of the present invention, there is provided a method of discriminating a modulation technique through which a signal is modulated to a modulated signal dividable into plural portions each equal in time period to a modulation period, each of the plural portions has a modulated section subjected to a modulation through the modulation technique and followed by a non-modulated section, the method comprises the steps of a) extracting discrete values from a waveform of the modulated signal so as to produce a series of samples expressing the discrete values, b) specifying groups of samples expressing the non-modulated sections in the plural portions, c) determining a time period between the group of samples in one of the plural portions and the group of samples in another of the plural portions next to the one of the plural portions and d) determining that the modulation technique is same as a predetermined modulation technique when the time period is equal to the modulation period.

BRIEF DESCRIPTION OF THE DRAWINGS

The features and advantages of the discriminator, demodulator, automatic player musical instrument and method will be more clearly understood from the following description taken in conjunction with the accompanying drawings, in which.

DESCRIPTION OF THE PREFERRED EMBODIMENTS

Figure 1:
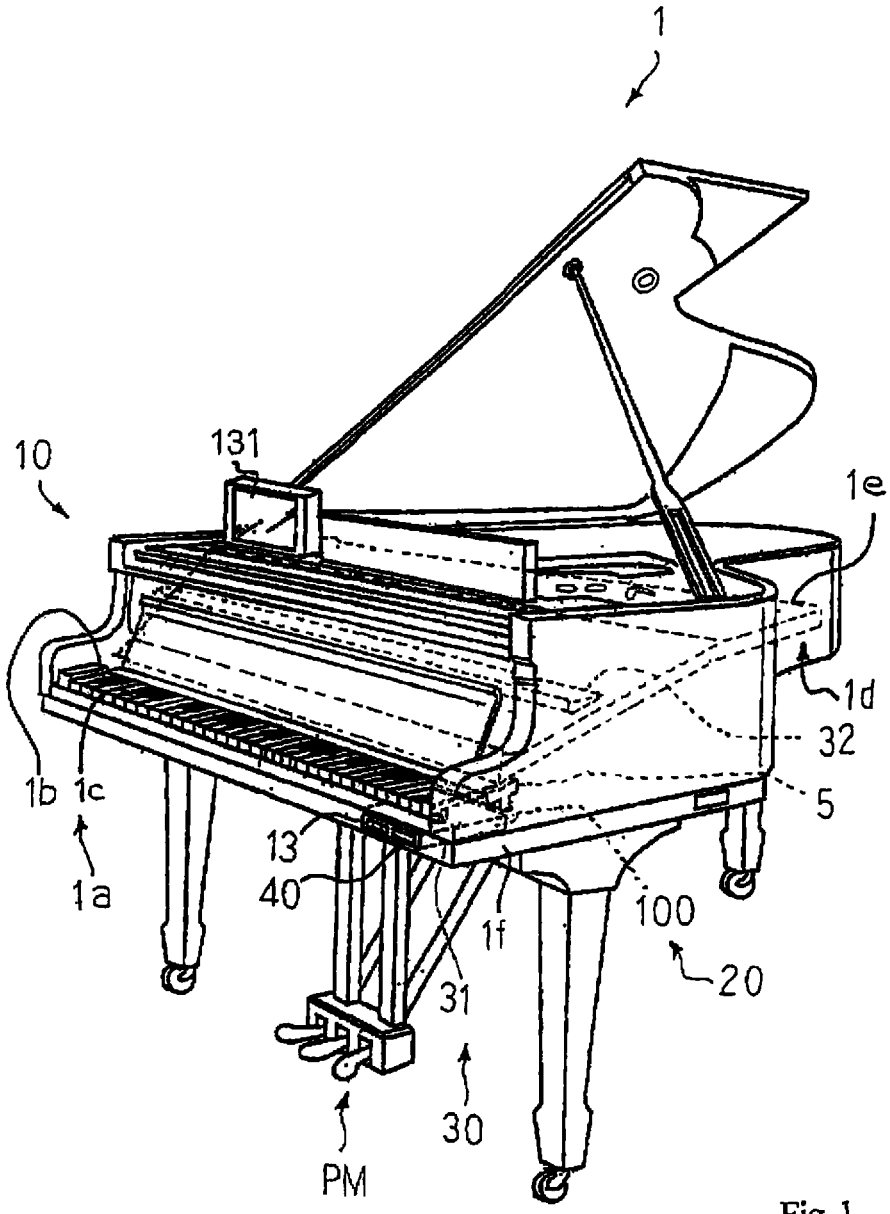
FIG. 1 is a perspective view showing the external appearance of an automatic player piano of the present invention.

A musical instrument embodying the present invention largely comprises a signal demodulator and a tone generator. A modulated signal is supplied to the signal demodulator, and the signal demodulator demodulates the modulated signal to a music signal through a suitable demodulation technique corresponding to a discriminated modulation technique. The music signal is supplied from the signal demodulator to the tone generator, and the tone generator produces tones on the basis of the demodulated music signal.

The signal demodulator reproduces the music signal from a modulated signal through the demodulation technique. In order to determine the demodulation technique, it is necessary to determine the corresponding modulation technique through which the modulated signal was produced. For this reason, the signal demodulator includes a discriminator and a signal demodulating module. The signal demodulating module determines the corresponding modulation technique, and informs the signal demodulating module of the corresponding modulation technique. For this reason, the signal demodulating module selects the suitable demodulation technique from plural candidates, and demodulates the modulated signal to the music signal.

A principle of discrimination for a certain modulation technique is based on the following fact. The modulated signal, which was produced through the certain modulation technique, is dividable into plural portions, and each of the plural portions continues over a time period equal to a modulation period. The modulation period is defined as a time period in which a carrier signal is modulated with each part of an input signal, i.e., the music signal. When the carrier signal is modulated with the input signal through the certain modulation technique, each part of the input signal influences an early stage of each portion, and the waveform of carrier signal follows the modulated section of each portion. The time period between the modulated section in a portion and the corresponding modulated section in the next portion is equal to the modulation period. Therefore, the certain modulation technique is discriminative through the time period between the modulated section in a portion and the corresponding modulated section in the next portion. In the discriminator, the certain modulation technique is discriminated to see whether or not the waveform of modulated signal exhibit's the above-described particular feature.

The discriminator includes an information processor having information processing capability and a sampler extracting discrete values from the waveform of the modulated signal so as to produce a series of samples expressing the discrete values. The series of samples is supplied from the sampler to the information processor.

A computer program runs on the information processor so as to realize a detector, a measurer and a determiner. The detector, measurer and determiner are hereinafter described in detail.

The detector is supplied with the series of samples from the sampler, and specifies groups of samples expressing the non-modulated sections in the plural portions. The detector may specify each group of samples through an integration of the samples of group, because the group of samples has a predetermined integrated value in so far as the group of samples expresses the non-modulated section. In order to eliminate influence of noise component from the integration, the groups of samples are deemed to have the predetermined integrated value when the integrated value is fallen within a neighborhood of the predetermined value.

The measurer is supplied with the groups of samples from the detector, and measures the time period between the group of samples in one of the plural portions and the group of samples in another of the plural portions next to the aforesaid one of the plural portions. The measurer informs the determiner of the measured value of the time period.

The determiner compares the time period with the modulation period to see whether or not the time period is equal to the modulation period. When the time period is equal to the modulation period, the determiner determines that the modulation technique is same as the certain modulation technique, i.e., a predetermined modulation technique on the condition that the answer is given affirmative. The determiner notifies the signal modulating module of the predetermined modulation. For this reason, the modulated signal is demodulated to the music signal through the demodulation technique corresponding to the discriminated modulation technique.

The music signal is supplied from the signal modulating module to the tone generator so as to produce the tones on the basis of the music signal.

The discrimination of the present invention is highly reliable, because the integrated value is well consistent with the predetermined value rather than the peak-to-peak value is consistent with a predetermined value.

The method employed in the discriminator is expressed as a series of steps a) extracting discrete values from a waveform of the modulated signal so as to produce a series of samples expressing the discrete values, b) specifying groups of samples expressing the non-modulated sections in the plural portions, c) determining a time period between the group of samples in one of the plural portions and the group of samples in another of the plural portions next to the one of the plural portions and d) determining that the modulation technique is same as a predetermined modulation technique when the time period is equal to the modulation period.

In the following description, term "front" is indicative of a position closer to a human player, who sits on a stool for fingering, than another position modified with term "rear", and a "fore-and-aft" direction extends along a line drawn between a front position" and a corresponding rear position. A "lateral direction" crosses the fore-and-aft direction at right angle, and an "up-and-down" direction is normal with a plane defined by the fore-and-aft direction and lateral direction. "Right" and "left" are determined from the viewpoint of the human player. Term "standard performance" means a performance carried by a human player, and term "automatic performance" is a performance carried out by the automatic player without any fingering of the human player.

First Embodiment

Referring first to FIG. 1 of the drawings, an automatic player piano 1 embodying the present invention largely comprises an acoustic piano 10, a playback system 20 and a recording system 30. The acoustic piano 10 is available for the standard performance. The recording system 30 is provided in association with the acoustic piano 10, and the standard performance is recorded through the recording system 30. The playback system 20 is connected to the recording system 30 and acoustic piano 10, and reproduces the performance through the acoustic piano 10 or regardless of the acoustic piano 10 on the basis of pieces of music data stored in the recording system 30. Pieces of music data may be supplied from the outside of the automatic player piano 10. In other words, the standard performance, which is recorded through the recording system 30, is not always reproduced through the playback system 20.

The acoustic piano 10 has a keyboard 1*a*, which includes black keys 1*b* and white keys 1*c*, cabinet 1*d* and a mechanical tone generator 1*e*. The keyboard 1*a* is mounted on a front portion of the cabinet 1*d*, and is exposed to a human player. The mechanical tone generator 1*e* is housed in the cabinet 1*d*, and the keyboard 1*a* is connected to the mechanical tone generator 1*e*. While a human player is selectively depressing and releasing the black keys 1*b* and white keys 1*c*, the depressed keys 1*b* and 1*c* activate the mechanical tone generator 1*e* so as to produce the acoustic tones, and the released keys 1*b* and 1*c* deactivate the mechanical tone generator 1*e* so that the acoustic tones are decayed. Thus, the acoustic piano 10 is responsive to fingering of a human player on the keyboard 1*a* for the standard performance.

The recording system 30 is installed inside the acoustic piano 10, and is of the type storing pieces of music data expressing the standard performance in the form of quasi audio data codes Sg(t) together with audio data codes expressing external sound in a suitable information storage medium such as, for example, a compact disk. In this instance, the audio data codes and quasi audio data codes Sg(t) are prepared in accordance with the protocols written in the Red Book. While a human player is fingering a music tune on the acoustic piano 10, music data codes, which expressing the standard performance, are asynchronously produced, and the music data codes and synchronous nibbles, i.e., a continuous data stream is modulated to a quasi audio signal Sg'(t). The quasi audio signal Sg'(t), i.e., modulated signal is converted to quasi audio data codes Sg(t), and the quasi audio data codes Sg(t) are stored in one of the two channels of the compact disk.

The playback system 20 is installed inside the acoustic piano 10, and is broken down into a music data code reproducer 20*a*, an automatic player 20*b*, a digital-to-analog converter 20*c* and an electronic tone generating system 23. The quasi audio data codes Sg(t) are converted to the quasi audio signal Sg'(t) through the digital-to-analog 20*c*, and the quasi audio signal Sg'(t) is examined in order to determine a suitable demodulation technique corresponding to the modulating technique employed in the recording system 30. The quasi audio signal Sg'(t) is demodulated into the continuous data stream through the suitable demodulation technique, and the music data codes are recovered from the continuous data stream. Thus, the music data codes are recovered from the quasi audio data codes Sg(t) through the music data code reproducer 20*a*. The music data codes are supplied to the automatic player 20*b* or electronic tone generating system 23. The automatic player 20*b* reenacts the performance on the basis of the music data codes. Thus, the automatic performance is realized through the automatic player 20*b*. In case where the user selects the electronic tone generating system 23, electronic tones are generated on the basis of the music data codes through the electronic tone generating system 23.

The Structure of Acoustic Piano

Figure 2:
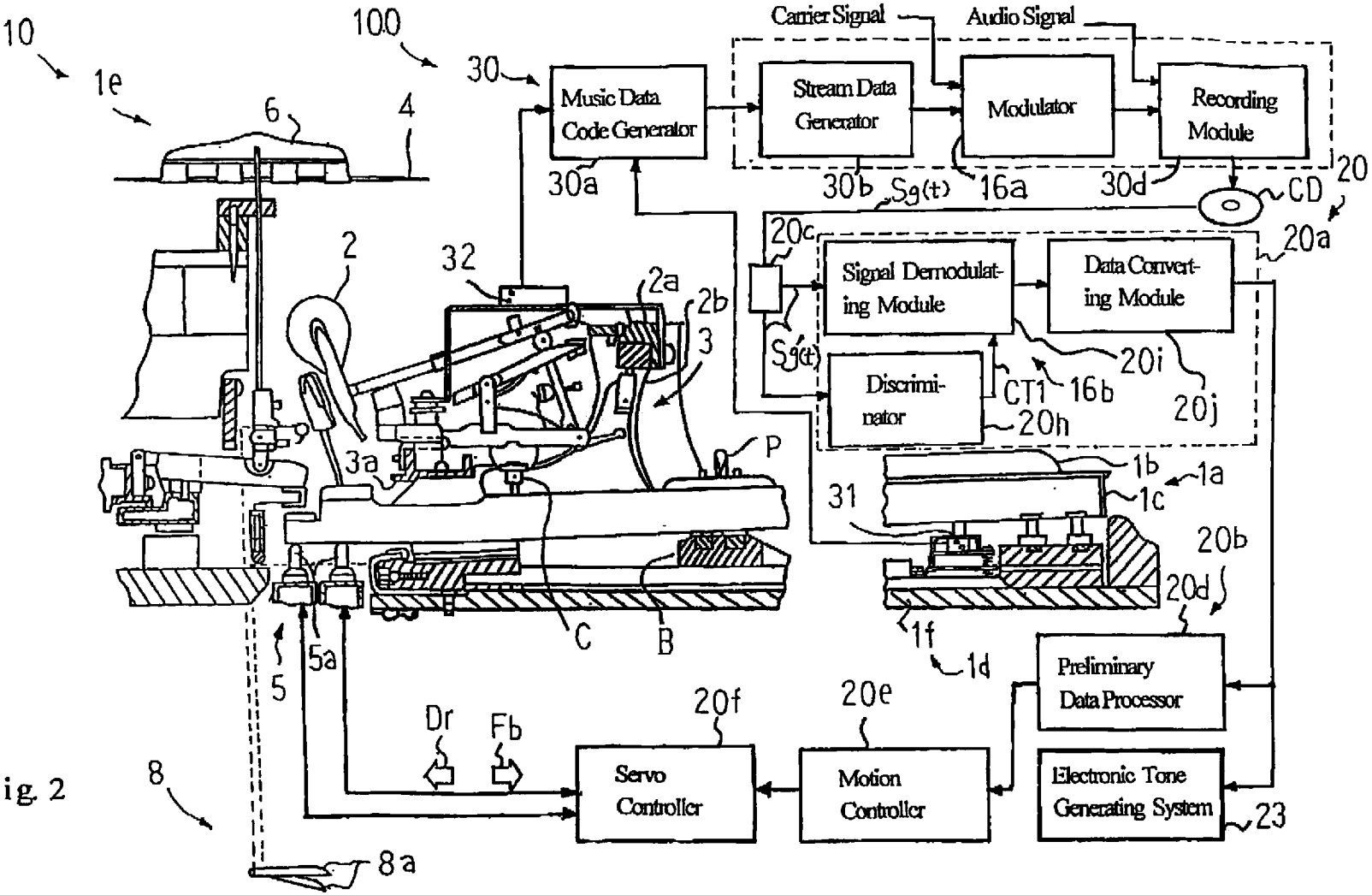
FIG. 2 is a partially cut-off side view showing the structure of a mechanical tone generating system incorporated in the automatic player piano.

Turning to FIG. 2, the mechanical tone generator 1*e* includes hammers 2, action units 3, strings 4, dampers 6 and pedal mechanisms 8. The hammers 2 are respectively associated with the keys 1*b* and 1*c* of the keyboard 1*e*, and the action units 3 are provided between the keys 1*b* and 1*c* and hammers 3. The strings 4 are respectively associated with the hammers 2, and the dampers 6 are respectively provided between the keys 1*b* and 1*c* and strings 4.

As described hereinbefore, the black keys 1*b* and white keys 1*c* are incorporated in the keyboard 1*a*, and the total number of keys 1*b* and 1*c* is eighty-eight in this instance. The keys 1*b* and 1*c* are specified with a key number Kn, and the key number Kn is varied from 1 to 88. The eighty-eight keys 1*b* and 1*c* are arranged in the lateral direction, which is in parallel to a normal direction with respect to the sheet of paper where FIG. 2 is drawn.

The black keys 1*b* and white keys 1*c* have respective balance pins P and respective capstan screws C. The balance pins P upwardly project from a balance rail B, which laterally extends on the key bed If of the cabinet 1*d*, through the intermediate portions of keys 1*b* and 1*c*, and offer fulcrums to the associated keys 1*b* and 1*c*. When the front portions of keys 1*b* and 1*c* are depressed, the front portions of keys 1*b* and 1*c* are rotated about the balance rail B, and are sunk. On the other hand, the rear portions of keys 1*b* and 1*c* are lifted. When a human player or the automatic player 20*b* removes force from the keys 1*b* and 1*c*, the front portions of keys 1*b* and 1*c* are moved to be spaced from the key bed 1*f* by the longest distance, and the keys 1*b* and 1*c* reach rest positions. On the other hand, when the human player or the automatic player 20*a* exerts the force on the keys 1*b* and 1*c*, the front portions of keys 1*b* and 1*c* are moved in the opposite direction, and the keys 1*b* and 1*c* reach end positions. Term "depressed key"

means the key 1*b* or 1*c* moved toward the end position, and term "released key" means the key 1*b* or 1*c* moved toward the rest position.

The hammers 2 are arranged in the lateral direction, and are rotatably supported by a hammer flange rail 2*a*, which in turn is supported by action brackets 2*b*. The action brackets 2*b* stands on the key bed 1*f*, and keep the hammers 2 over the rear portions of associated black keys 1*b* and the rear portions of associated white keys 1*c*.

The action units 3 are respectively provided between the keys 1*b* and 1*c* and the hammers 2, and are rotatably supported by a whippen rail 3*a*. The whippen rail 3*a* laterally extends over the rear portions of black keys 1*b* and the rear portions of white keys 1*c*, and is supported by the action brackets 2*b*. The action units 3 are held in contact with the capstan screws C of the associated keys 1*b* and 1*c* so that the depressed keys 1*b* and 1*c* give rise to rotation of the associated action units 3 about the whippen rail 3*a*. While the action units 3 are rotating about the whippen rail 3*a*, the rotating action units 3 force the associated hammers 2 to rotate until escape between the action units 3 and the hammers 2. The hammers 2 start free rotation toward the associated strings 4 at the escape. The detailed behavior of action units 3 is same as that of a standard grand piano, and, for this reason, no further description is incorporated for the sake of simplicity.

The strings 4 are stretched over the associated hammers 2, and are designed to produce the acoustic tones at difference in pitch from one another. The hammers 2 are brought into collision with the associated strings 4 at the end of free rotation, and give rise to vibrations of the associated strings 4 through the collision.

The loudness of acoustic tones is proportional to the final hammer velocity immediately before the collision, and the final hammer velocity is proportional to the key velocity at a reference point, which is a particular key position on the loci of keys 1*b* and 1*c*. The key velocity at the reference point is hereinafter referred to as "reference key velocity". In the standard performance, the human player regulates the finger force exerted on the keys 1*b* and 1*c* to an appropriate value so as to impart the reference key velocity to the keys 1*b* and 1*c*. Similarly, the automatic player 20*b* regulates the electromagnetic force exerted on the keys 1*b* and 1*c* to the appropriate value in the automatic performance.

The dampers 6 are connected to the rearmost portions of associated keys 1*b* and 1*c*, and are spaced from and brought into contact with the associated strings 4. While the associated keys 1*b* and 1*c* are staying at the rest positions, the rearmost portions of keys 1*b* and 1*c* do not exert force on the dampers 6 in the upward direction so that the dampers 6 are held in contact with the associated strings 4. The dampers 6 do not permit the strings 4 to vibrate. While a human player or the automatic player 20*b* is depressing the keys 1*b* and 1*c*, the rearmost portions of keys 1*b* and 1*c* start to exert the force on the associated dampers 6 on the way to the end positions, and, thereafter, cause the dampers 6 to be spaced from the associated strings 4. When the dampers 6 are spaced from the associated strings 4, the strings 4 get ready to vibrate. The hammers 2 are brought into collision with the strings 4 after the dampers 6 have been spaced from the strings 4. The acoustic tones are produced through the vibrations of strings 4. When the human player or the automatic player 20*b* releases the depressed keys 1*b* and 1*c*, the released keys 1*b* and 1*c* start to move toward the rest positions, and the dampers 6 are moved in the downward direction due to the self-weight of dampers 6. The dampers 6 are brought into contact with the strings 4 on the way to the rest positions, and make the vibrations of strings 4 and, accordingly, acoustic tones decayed.

The pedal mechanisms 8 are selectively connected to the dampers 6 and keyboard 1*a*, and a human player steps on the pedals 8*a* of pedal mechanisms 8 for imparting artificial expression to the acoustic tones. The pedals 8*a* are called as "damper pedal", "soft pedal" and "sostenuto pedal". The damper pedal or sostenuto pedal make all of the dampers 6 or selected one of ones of dampers 6 spaced from the associated strings 4 so that the acoustic tone or tones are prolonged. On the other hand, the soft pedal makes the hammers 2 laterally slightly moved so that the hammers 2 are brought into collision with the reduced number of wires of associated strings 4. As a result, the loudness of acoustic tones is lessened.

Electronic System of Automatic Player Piano

Turning back to FIG. 1, an electronic system is incorporated in the automatic player piano 1, and the playback system 20 and recording system 30 are realized through execution of a computer program, which is loaded into the electronic system.

Figure 3:
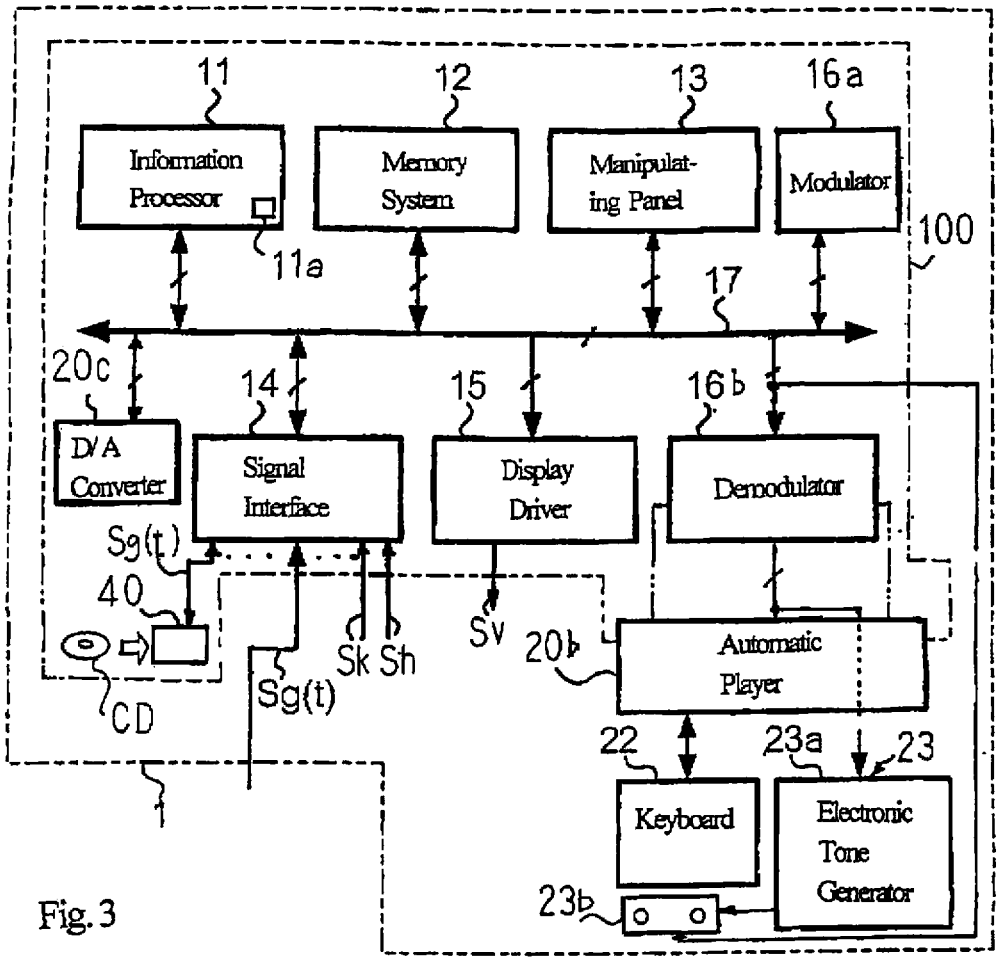
FIG. 3 is a block diagram showing the system configuration of a controlling unit incorporated in the automatic player piano.

The electronic system includes a controlling unit 100, an array of solenoid-operated key actuators 5, an array of key sensors 31, an array of hammer sensors 32, the electronic tone generating system 23, which is shown in FIG. 3, and a display panel 131. Though not shown in the drawings, solenoid-operated pedal actuators and pedal sensors are further provided in association with the pedals. However, the solenoid-operated pedal actuators for the pedals and pedal sensors are deleted from the drawings for the sake of simplicity.

The controlling unit 100 is connected to the solenoid-operated actuators 5, key sensors 31, hammer sensors 32, electronic tone generating system 23 and display panel 131. While the computer program is running for communication with users, the controlling unit 100 supplies a video signal Sv to the display panel 131 so as to produce visual images on the display panel 131 for communication with the user.

While the user is recording his or her performance on the piano 10, the controlling unit 100 fetches pieces of key position data and pieces of hammer position data, which are supplied from the key sensors 31 and hammer sensors 32 through key position signals Sk and hammer position signals Sh. The pieces of key position data and pieces of hammer position data are analyzed, and pieces of music data are produced on the basis of the pieces of key position data and pieces of hammer position data through the analysis. The pieces of music data express tone to be produced and tones to be decayed, and are stored in the music data codes. In this instance, the music data codes are prepared in accordance with the MIDI protocols.

When the user wishes a playback, he or she instructs the controlling unit 100 to reproduce a music tune, the controlling unit 100 reads out the audio data codes and quasi audio data codes Sg(t) from a compact disk CD or another sort of information storage medium, and recovers the music data codes from the quasi audio data codes Sg(t) through the demodulation and deletion of synchronous nibbles. Driving signals Dr are produced on the basis of the music data codes, and are supplied to the solenoid-operated key actuators 5 for selectively driving the keys 1*b* and 1*c*. Otherwise, the music data codes are supplied to the electronic tone generating system 23. The audio data codes are supplied to the electronic tone generating system 23, and electronic tones are generated through the electronic tone generating system 23.

Turning to FIG. 3 of the drawings, the controlling unit 100 includes an information processor 11, a memory system 12, the manipulating panel 13, a signal interface 14, a display driver 15, a modulator 16*a*, a demodulator 16*b*, the digital-to-analog converter 20*c* and a bus system 17 and a disk driver 40. The information processor 11, memory system 12, manipulating panel 13, signal interface 14, display driver 15, modulator 16*a*, demodulator 16*b* and digital-to-analog converter 20*c* are connected to the bus system 17 so that the information processor 11 is communicable with the memory system 12, manipulating panel 13, signal interface 14, display driver 15, modulator 16*a*, demodulator 16*b* and digital-to-analog converter 20*c* through the bus system 17. Although counters and other peripheral circuits are incorporated in the controlling unit 100, they are not shown in FIG. 3 for the sake of simplicity. Several counters are used for timer interruptions, and a time interval between the key events is measured through another counter. Other counters serve as index counters as described in conjunction with the music data code reproducer 20*a*.

The information processor 11 has an information processing capability, and achieves jobs expressed by the computer program. The memory system 12 has various sorts of memory devices, which serve as a program memory and working memory. The computer program is stored in the program memory. The information processor 11 sequentially reads out the instruction codes from the program memory, and executes the read-out instructions so as to achieve the given tasks. The working memory offers a temporary data storage to the information processor 11 so that the results of execution are held in the working memory. The working memory has a memory location where a set of music data codes is stored, and another memory location is assigned to the pieces of key position data and pieces of hammer position data. Yet another memory location is assigned to the audio data codes and quasi audio data codes Sg(t). The memory system 12 has a memory device with a large data holding capacity such as, for example, a hard disk unit, and music files are created in the memory device.

The manipulating panel 13 has plural keys, buttons and levers, and the user gives his or her instructions through the keys, buttons and levers. A mouse is further connected to the manipulating panel 13 for the display panel 131.

The key sensors 31 and hammer sensors 32 are connected to predetermined signal ports of the signal interface 14, and another signal port is assigned to the disk driver 40. The audio data codes and quasi audio data codes Sg(t) arrives at the signal port. Yet another signal port is assigned to an external device such as, for example, a DVD (Digital Versatile Disk) driver, semiconductor memory device and a modem through a signal wire or a radio channel. The modem may be connected to a communication network (not shown) such as, for example, the internet. The audio data codes and quasi audio data codes Sg(t) may arrive at the signal interface 14 through the communication network. Although another signal port is assigned to the driving signal Dr, the driving signal Dr and signal port are not illustrated in FIG. 3, because the block 20*b* stands for the architecture of automatic player 20*b*.

Analog-to-digital converters (not shown) are further provided in the signal interface 14, and the key position signals Sk and hammer position signals Sh are converted to digital key position signals and digital hammer position signal through the analog-to-digital converters. A pulse width modulator is further incorporated in the signal interface 14, and the driving signal Dr is supplied from the pulse width modulator through the signal port to the solenoid-operated key actuators 5. The solenoid-operated key actuators 5 are equipped with built-in plunger sensors, and feedback signals Fb are supplied from the built-in plunger sensors to the signal interface 14. However, the feedback signals Fb are not shown in FIG. 3, because the plunger velocity signals Fb are propagated in the box labeled with 20*b*.

The display driver 15 is connected to the display panel 131, and the video signal Sv is supplied from the display driver 15 to the display panel 131. The video signal Sv is representative of visual images of job list, menu, prompt message and status message. In this instance, a touch panel is incorporated in the display panel 131 so that users can give their instructions through the touch panel by pressing an image on the display panel with their fingers. The video signal Sv may express images of a music score or a moving picture.

A 16 DPSK is employed in the modulator 16*a*, and the circuit configuration of modulator 16*a* is same as that disclosed in Japan Patent Application laid-open No. 2002-94593. For this reason, no further description is hereinafter incorporated for the sake of simplicity.

The digital-to-analog converter 20*c* converts the quasi audio data codes Sg(t) to the quasi audio signal Sg'(t). The digital-to-audio converter 20*c* may be incorporated in the disk driver 40. A signal demodulating module 20*i* (see FIG. 2) of the demodulator 16*b* is same as that disclosed in the Japan Patent Application laid-open so that description is omitted. However, a discriminator 20*h* is different from that of the prior art demodulator disclosed in the Japan Patent Application laid-open, and is hereinlater described in detail.

The disk driver 40 has a disk tray and a pickup. A compact disk CD is put on the disk tray, and the audio data codes and quasi audio data codes Sg(t) are read out from the compact disk CD through the pickup. The audio data codes and quasi audio data codes Sg(t) are transferred to the memory system 12, and are stored in the working memory.

The electronic tone generating system 23 includes an electronic tone generator 23*a* and a sound system 23*b*. A waveform memory is provided inside the electronic tone generating system 23, and pieces of waveform data are stored in the waveform memory. When the music data code arrives at the electronic tone generating system 23, the pieces of waveform data are read out from the waveform memory, and an analog audio signal is produced from the pieces of waveform memory. The analog audio signal is supplied to the sound system 23*b*, and is converted to electronic tones through the sound system 23*b*. The audio data codes are directly supplied to the sound system 23*b*, and are converted to electric tones.

The computer program is broken down into a main routine program and sub-routine programs. While the main routine program is running on the controlling unit 100, the users communicate with the controlling unit 100.

The main routine program branches selectively to the subroutine programs through timer interruptions. One of the subroutine programs is assigned to data accumulation. Another subroutine program is assigned to the recording system 30, yet another subroutine program is assigned to the music data code reproducer 20*a*, and still another subroutine program is assigned to the automatic player 20*b*.

While the subroutine program for data accumulation is running on the information processor 11, the digital key position signals, digital hammer position signals, audio data codes and quasi audio data codes Sg(t) are transferred from the signal interface 14 to the memory system 12, and are stored in the working memory of memory system 12. Moreover, after the conversion from the quasi audio data codes Sg(t) to the quasi audio signal Sg'(t), the discrete values of quasi audio signal Sg'(t) are sampled and stored in the working memory through the subroutine program for data accumulation as will be hereinlater described in conjunction with the music data code reproducer 20*a*.

Description is hereinafter made on the subroutine programs in conjunction with the recording system 30, music data code reproducer 20*a* and automatic player 20*b*.

Recording System

Turning back to FIG. 2 of the drawings, the key sensors 31, hammer sensors 32 and controlling system 100 form in combination the recording system 30, and the subroutine program for recording periodically runs on the information processor 11 of controlling system 100. While the subroutine program for recording is running on the information processor 11, the standard performance is recorded as a result of the function of recording system 30. The function of recording system 30 is expressed as a music data code generator 30*a*, a stream data generator 30*b*, the modulator 16*a* and a recording module 30*d*.

The music data code generator 30*a* behaves as follows. The pieces of key position data and pieces of hammer position data are analyzed through the music data code generator 30*a* so as to determine the pitch of a tone, loudness of the tone and timing to produce or decay the tone. A human player is assumed to depress a key 1*b* or 1*c*. The depressed key 1*b* or 1*c* starts to travel from the rest position toward the end position, and the digital key position signal changes the key position together with time. Since the information processor 11 checks the working memory for a depressed key and a released key, the information processor 11 notices the depressed key 1*b* or 1*c*, and specifies the key number assigned to the depressed key 1*b* or 1*c*. Moreover, the information processor 11 calculates the key velocity on the basis of the distance between two points on the key trajectory and the time period consumed in travel between the two points, and presumes the loudness or MIDI velocity on the basis of the key velocity. The music data code, which expresses the channel message "note-on", key number and MIDI velocity, is produced for the depressed key 1*b* or 1*c*, and is hereinafter referred to as "note-on key event code." On the other hand, when the human player releases the depressed key 1*b* or 1*c*, the released key 1*b* or 1*c* starts to travel toward the rest position. The information processor 11 notices the released key 1*b* or 1*c*, and specifies the key number assigned to the released key 1*b* or 1*c*. The information processor 11 calculates the velocity of released key 1*b* or 1*c*, and presumes the time at which the damper 6 is brought into contact with the vibrating string 4. The music data code, which expresses the channel message "note-off" and key number is produced for the released key 1*b* or 1*c*, and is hereinafter referred to as "note-off" key event code. Term "key event" stands for both of the note-on and note-off, and term "key event code" is indicative of either note-on key event code or note-off key event code. A duration data code expresses a time interval between the previous note-on key event or previous note-off key event and the present note-on key event or present note-off key event. Other voice messages and system messages may be produced, and term "MIDI data code" expresses all of the key event code, duration data code and other message codes.

The stream data generator 30*b* behaves as follows. Since the music data code generator 30*a* intermittently produces the MIDI data codes, vacant time periods take place between the MIDI data code and the next MIDI data code. In order to make up the vacant time periods, the MIDI data codes are transferred from the music data code generator 30*a* to the steam data generator 30*b*. A synchronous nibble code expresses meaninglessness from the viewpoint of the MIDI protocols, and the vacant time periods are made up with the synchronous nibble code or codes through the stream data generator 30*b*. As a result, a continuous stream data is output from the stream data generator 30*b*. The continuous stream data is formed from the MIDI data codes and synchronous nibble codes.

The continuous stream data is transferred from the stream data generator 30*b* to the modulator 16*a*. The modulator 16*a* has the circuit configuration same as that disclosed in Japan Patent Application laid-open No. 2002-94593 as described hereinbefore, and the 16 DPSK is employed as the modulating technique so that the quasi audio signal Sg'(t) expresses a particular feature of the 16 DPSK. However, a binary FSK may be employed as the modulating technique. A carrier signal is supplied to the modulator 16*a*, and is modulated with the nibbles of the continuous stream data. As a result, a modulated signal, i.e., the quasi audio signal Sg'(t) is output from the modulator 16*a*. In this instance, the carrier signal has a sign waveform at 6.3 KHz, and the period of carrier signal is expressed as T. The phase modulation is carried out at 2T.

The modulated signal is transferred from the modulator 16*a* to the recording module 30*d*. The quasi audio signal Sg'(t) is periodically sampled, and is converted to the quasi audio data codes Sg(t) through the PCM technique in the recording module 30*d*. The quasi audio data codes Sg(t) are written in the right channel of the compact disk CD. An external audio signal may be further supplied to the recording module 30*d* so as to be written in the left channel of the compact disk CD.

Automatic Player

The controlling unit 100 and solenoid-operated key actuators 5 form in combination the automatic player 20*b*. The number of solenoid-operated actuators 5 for the keyboard 1*a* is equal to the number of keys 1*b* and 1*c* so that the solenoid-operated actuators 5 for the keyboard 1*a* are also specified with the key number varied from 1 to 88. The solenoid-operated actuators 5 are provided below the rear portions of keys 1*b* and 1*c*, respectively, as shown in FIG. 2.

The subroutine program for the automatic player realizes functions called as a preliminary data processor 20*d*, a motion controller 20*e* and a servo controller 20*f* shown in FIG. 2. The preliminary data processor 20*d*, motion controller 20*e* and servo controller 20*f* are hereinafter described.

Although the music data codes are normalized for all the products of automatic player pianos, the component parts of acoustic piano 10 and solenoid-operated actuators 5 have individualities so that the music data codes are to be individualized. One of the jobs assigned to the preliminary data processor 20*d* is the individualization. Another job assigned to the preliminary data processor 20*d* is to select the key event code or key event codes to be processed for the next key event or next key events. The preliminary data processor 20*d* periodically checks the counter assigned to the measurement of duration to see what key event code or codes are to be processed. When the preliminary data processor 20*d* finds the key event data or key event codes to be processed, the preliminary data processor 20*d* transfers the key event code or key event codes to be processed to the motion controller 20*e*.

The motion controller 20*e* analyzes the key event codes for determining the key or keys 1*b* and 1*c* to be depressed or released, and specifies the solenoid-operated actuator or actuators 5 associated with the key or keys 1*b* and 1*c* to be depressed or released.

The motion controller 20*e* further analyzes the key event code or codes and duration data codes for a reference forward key trajectory and a reference backward key trajectory. Both of the reference forward key trajectory and reference backward key trajectory are simply referred to as "reference key trajectory."

The reference forward key trajectory is a series of values of target key position varied with time for a depressed key 1*b* or 1*c*. The reference forward key trajectories are determined in such a manner that the depressed keys 1*b* and 1*c* pass through the respective reference points at target values of reference key velocity so as to give target values of final hammer velocity to the associated hammers 2. The associated hammers are brought into collision with the strings 4 at the final hammer velocity at the target time to generate the acoustic tones in so far as the depressed keys 1*b* and 1*c* travel on the reference forward key trajectories. The reference backward key trajectory is also a series of values of target key position varied with time for a released key 1*b* or 1*c*. The reference backward key trajectories are determined in such a manner that the released keys 1*b* and 1*c* cause the associated dampers 6 to be brought into contact with the vibrating strings 4 at time to delay the acoustic tones. The reference forward key trajectory and reference backward key trajectory are known to persons skilled in the art, and, for this reason, no further description is hereinafter incorporated for the sake of simplicity.

When the time to make a key 1*b* or 1*c* start to travel on the reference key trajectory comes, the motion controller 20*e* supplies the first value of target key position to the servo controller 20*f*. The motion controller 20*e* continues periodically to supply the other values of target key position to the servo controller 20*f* until the keys 1*b* and 1*c* reach the end of reference key trajectories. The feedback signal Fb expresses actual plunger velocity, i.e., actual key velocity, and is periodically fetched by the servo controller 20*f* for each of the keys 1*b* and 1*c* under the travel on the reference key trajectories. The servo controller 20*f* determines the actual key position on the basis of the series of values of actual key velocity. The servo controller 20*f* further determines the target key velocity on the basis of the series of values of target key position. The servo controller 20*f* calculates the difference between the actual key velocity and the target key velocity and the difference between the actual key position and the target key position, and regulates the amount of mean current of driving signal Dr to an appropriate value so as to minimize the differences. As a result, the keys 1*b* and 1*c* are forced to travel on the reference key trajectories.

One of the keys 1*b* and 1*c* is assumed to be depressed in the automatic performance. The motion controller 20*e* determines the reference forward key trajectory for the key 1*b* or 1*c*, and informs the servo controller 20*f* of the reference forward key trajectory. The servo controller 20*f* determines the initial value of the amount of mean current, and adjusts the driving signal Dr to the amount of mean current. The driving signal Dr is supplied to the solenoid-operated key actuator 5, and creates electromagnetic field around the plunger 5*a*. The plunger 5*a* projects in the upward direction, and pushes the rear portion of associated key 1*b* or 1*c*. After the small amount of time interval, the servo controller 20*f* determines the target plunger velocity and actual plunger position, and calculates the difference between the actual key position and the target key position and the difference between the actual key velocity and the target key velocity. If the difference or differences take place, the servo controller 20*f* increases or decreases the amount of mean current.

The servo controller 20*f* periodically repeats the above-described job for the key 1*b* or 1*c* until the key 1*b* or 1*c* reaches the end of reference forward key trajectory. As a result, the key 1*b* or 1*c* is forced to travel on the reference forward key trajectory, and makes the associated hammer 2 brought into collision with the string 4 at the time to generate the acoustic tone at the target loudness.

If the time to release the depressed key 1*b* or 1*c* comes, the motion controller 20*e* determines the reference backward key trajectory for the key 1*b* or 1*c* to be released, and informs the servo controller 20*f* of the reference backward key trajectory. The servo controller 20*f* controls the amount of mean current, and makes the damper 6 to be brought into contact with the vibrating string 4 at the time to delay the tone.

Music Data Code Reproducer

The solenoid-operated key actuators 5 and controlling system 100 form in combination the music data code reproducer 20*a*, and the subroutine program for music data code reproducer 20*a* runs on the information processor 11 of controlling system 100. While the subroutine program for music data code reproducer 20*a* is running on the information processor 11, the MIDI music data codes are recovered from the quasi audio data codes Sg(t) stored in the compact disk CD. The set of quasi audio data codes Sg(t) may be stored through the recording module 30*d*. Otherwise, the set of quasi audio data codes Sg(t) is stored in the compact disk CD through another recording system, in which the binary FSK may be employed. The function of music data code reproducer 20*a* is expressed as a data converting module 20*j* and the discriminator 20*h* and signal demodulating module 20*i*. As described hereinbefore, the circuit configuration of signal demodulating module 20*i* is same as that disclosed in Japan Patent Application laid-open No. 2002-94593.

The quasi audio data codes Sg(t) are successively supplied from the disk driver 40 to the digital-to-analog converter 20*c*, and the quasi audio data codes Sg(t) are converted to the quasi audio signal. The quasi audio signal Sg'(t) is supplied to both of the discriminator 20*h* and signal demodulating module 20*i*. The discriminator 20*h* checks the quasi audio signal Sg'(t) to see what particular feature the quasi audio signal Sg'(t) exhibits, and determines a proper demodulating technique corresponding to the discriminated modulating technique employed in the modulator of recording system. The discriminating technique will be hereinlater described in detail.

The discriminator 20*h* supplies a control signal CT1 representative of the proper demodulating technique to the signal demodulating module 20*i* so that the signal demodulating module 20*i* reproduces the continuous data stream from the quasi audio signal Sg'(t) through the proper demodulating technique.

The continuous data stream is supplied from the signal demodulating module 20*i* to the data converting module 20*j*. The data converting module 20*j* eliminates the synchronous nibble codes from the continuous data stream so that the MIDI music data codes are recovered from the continuous data stream. The MIDI music data codes are supplied from the data converting module 20*j* to one of or both of the automatic player 20*b* and electronic tone generating system 23.

Discriminator

Figure 4:
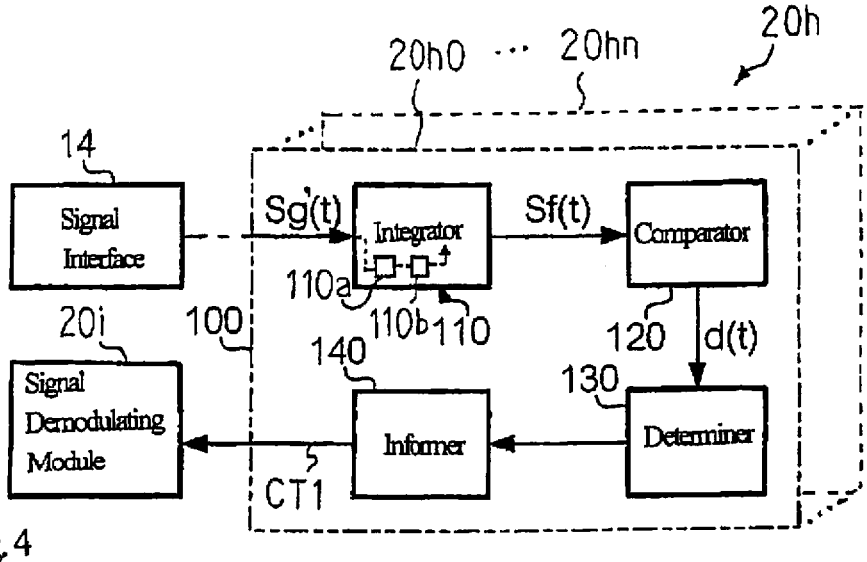
FIG. 4 is a block diagram showing the function blocks of a discriminator of the present invention.

Turning to FIG. 4, the functions of discriminator 20*h* includes plural function sub-blocks 20*h*0, . . . and 20*hn*, and the plural function sub-blocks 20*h*0 to 20*hn* are respectively assigned to plural modulating techniques different from one another. The function sub-block 20*h*0 is assigned to the 16DPSK, another of the plural function blocks 20*h*0 to 20*hn* is assigned to a sort of binary FSK, and yet another of the plural function blocks 20*h*0 to 20*hn* is assigned to another sort of binary FSK. The function block 20*h*0 discriminates whether or not the quasi audio signal Sg'(t) exhibits a particular feature of the 16DPSK. The particular feature of 16DPSK is not observed in the modulated signals produced through other modulation techniques such as 2FSK, because the carrier frequency is usually lower than that of the 16DPSK. The principle of the others of function sub-blocks 20*h*0 to 20*hn* may be same as that employed in the discriminator disclosed in Japan Patent Application laid-open No. 2002-94593.

The particular feature of 16DPSK is directed to the waveform of modulated signal. The modulation period 2T is longer than the period T of carrier signal, and the carrier signal is subjected to the phase modulated in an early stage of the modulation period 2T, and the waveform of non-modulated carrier signal follows the waveform of phase modulated signal in the latter stage of the modulation period 2T. Since the carrier signal has a sign curve, when the carrier signal is integrated over the period T, the value of integration is to be zero in the latter stage. If the latter stage of a modulation period 2T is spaced from the latter stage of the previous modulation period 2T by a time period equal to the modulation period 2T, the quasi audio signal Sg'(t) was surely produced through the 16DPSK. Thus, it is possible to discriminate the 16 DPSK on the basis of the waveform of quasi audio signal Sg'(t).

Description is focused on the function block **20*h*0, and no description on the other function sub-blocks is hereinafter incorporated for the sake of simplicity. The function sub-block 20*h*0 is broken down into an integrator 110, a comparator 120, a determiner 130 and an informer 140. The integrator 110 is partially implemented by hardware, and partially by software. However, the comparator 120, determiner 130 and informer 140** are implemented by software as described hereinlater in detail.

The integrator 110 has a sample-and-hold circuit **110*a* and a data buffer 110*b*, and the quasi audio signal Sg'(t) is supplied from the digital-to-analog converter 20*c* to the sample-and-hold circuit 110*a***, and the sampled value or discrete value on the waveform of quasi audio signal Sf'(t) is temporarily stored in the data buffer. The quasi audio signal Sg'(t) is sampled at 44.1 kHz so that seven samples, i.e., 44.1 kHz/6.3 kHz, are extracted from the quasi audio signal Sg'(t) during each period T through the execution of subroutine program for data accumulation. The samples are successively stored in the data buffer, and each sample is transferred to the working memory.

The samples are integrated through execution of a part of the subroutine program for the music data code reproducer **20*a*, and produces a digital integral signal Sf(t). When the integration is carried out for a discrete value Sg(n), which was sampled at time n, the discrete value Sg(n) and six previous discrete values Sg(n−1) to Sg(n−6) are read out from the working memory, and the information processor 11** determines a value Sf(n) of digital integral signal Sf(t), and the discrete value Sf(n) is stored in the working memory. The integration is expressed as $$Sf(n)=Sg(n)+Sg(n-1)+\ldots+Sg(n-6) \qquad \text{Equation 1}$$

where Sf(n) is the integrated value of n samples and Sg(n), Sg(n−1), . . . and Sg(n−6) are the discrete values of samples.

Similarly, when the integration is carried out for the next discrete value Sg(n+1), the discrete value Sg(n+1) and six previous discrete values Sg(n) to Sg(n−5) are read out from the working memory, and are integrated so as to determine the value Sf(n+1) of digital integral signal Sf(t).

Figure 5A:
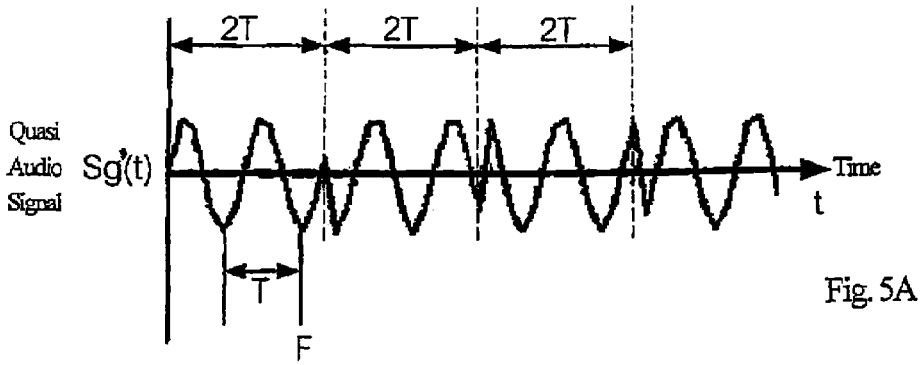
FIG. 5A is a graph showing the waveform of a quasi audio signal modulated through a 16 DPSK.
Figure 5B:
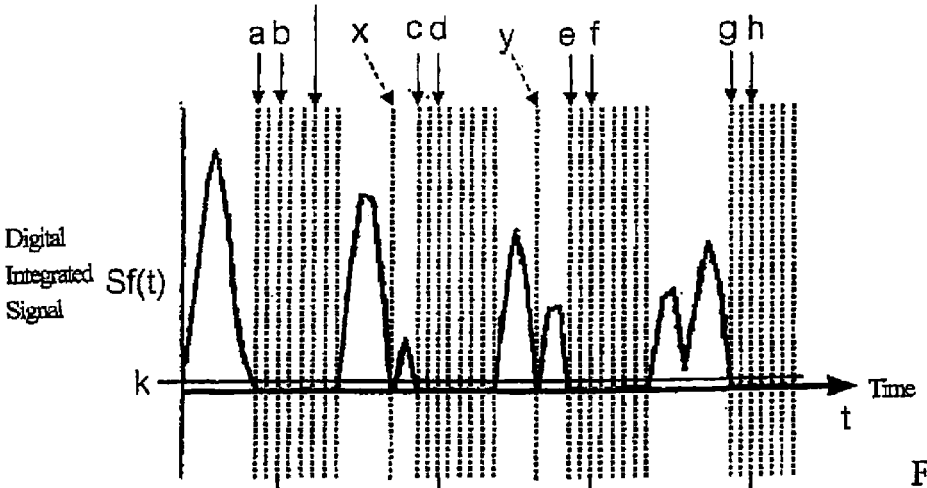
FIG. 5B is a graph showing the value of a digital integral signal.

FIG. 5A shows an example of the waveform of quasi audio signal Sg'(t), and the example of quasi audio signal Sg'(t) exhibits the particular feature of 16DPSK as will be understood from the following description. FIG. 5B shows the digital integral signal Sf(t) calculated on the basis of the samples or discrete values on the waveform of quasi audio signal Sg'(t) shown in FIG. 5A.

As described hereinbefore, the carrier signal has the sign waveform periodically varied at period T, and the modulation period of 16 DPSK is fixed to 2T. If the quasi audio signal Sg'(t) was produced through the 16DPSK, the value Sf(n) of digital integral signal Sf(t) during the latter stage of modulation period 2T is to be value "0" as indicated by arrow F in FIGS. 5A and 5B, because the quasi audio signal Sg'(t) in the latter stage does not include the change of phrase, which take place in the early stage after the boundary between two modulation periods 2T, between the sample Sg(n) and the sample Sg(n−6). The quasi audio signal Sg'(t) shown in FIG. 5A has the change of phrase only in the initial stage after the boundary between the modulation periods 2T. Thus, the quasi audio signal Sg'(t) exhibits the feature of 16 DPSK. In FIG. 5B, broken lines are indicative of the samples at which the digital integral signal Sf(t) has value "0".

The digital integral signal Sf(t) is further supplied from the integrator 110 to the comparator 120. The comparator 120 compares the value of digital integral signal Sf(t) with a threshold k. The value of threshold k is stored in a register **11*a* of the information processor 11. Although the digital integral signal Sf(t) on the samples in the latter stage theoretically has value "0", noise tends to ride on the quasi audio signal Sg'(t). In order to eliminate undesirable influence of the noise from the decision made by the discriminator 20*h*0, the value of digital integral signal Sf(t) is compared with the threshold k, and the discriminator 20*h*0** deems the digital integral signal Sf(t) to reach zero in so far as the actual value of digital integral signal Sf(t) is less than the value of threshold k. Thus, the threshold k defines a neighborhood of the predetermined value of zero.

When the comparator 120 confirms that the digital integral signal Sf(t) keeps the value less than the value of threshold k in a predetermined number of results of the integration, the comparator 120 produces a detecting signal d(t), and supplies the detecting signal d(t) to the determiner 130. The determiner 130 is responsive to the detecting signal d(t) so as to make the decision that the quasi audio signal Sg'(t) was produced through the 16 DPSK, and request the informer 140 to give a notice of discrimination to the signal demodulating module **20*i*. The informer 140 notifies the signal demodulating module 20*i*** of the discrimination of 16 DPSK. In this instance, the predetermined number is three.

Figure 6:
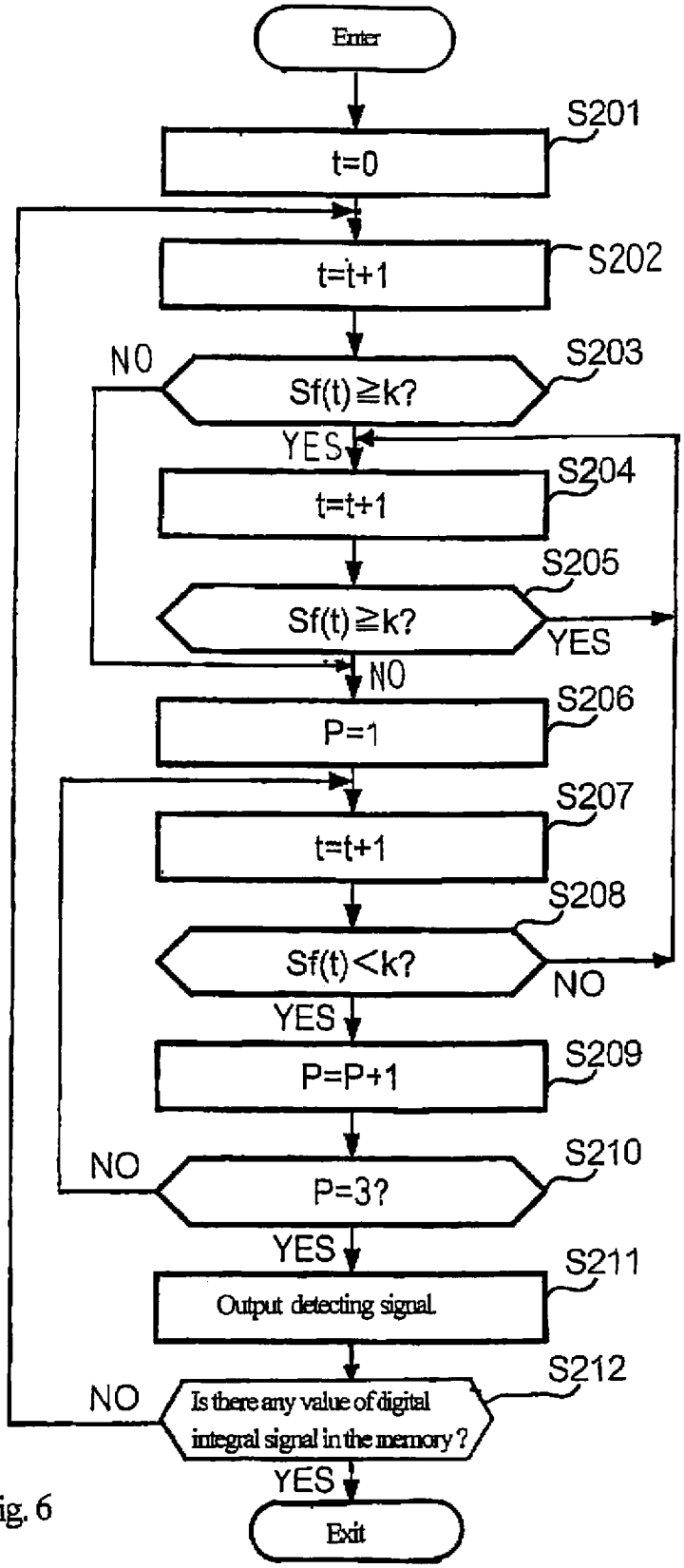
FIG. 6 is a flowchart showing a part of subroutine program for music data code reproducer.

FIG. 6 shows the part of the subroutine program for music data code reproducer, and the comparator 120 is realized through execution of the part of subroutine program for the music data code reproducer **20*a***. The part of subroutine program is once executed in the initial stage of the playback.

Upon entry into the job sequence shown in FIG. 6, the information processor 11 firstly resets the counter "t" to zero as by step S201.

Subsequently, the information processor 11 increments the counter "t" by 1 as by step S202. The counter "t" is indicative of the value of digital integral signal Sf(1). Then, the information processor 11 reads out the digital integral signal Sf(t) from the working memory, and compares the read-out digital integral signal Sf(1) with the threshold k to see whether or not the value of integral signal Sf(1) is equal to or greater than the value of threshold k as by step S203.

When the digital integral signal Sf(1) has the value equal to or greater than the threshold k, the answer at step S203 is given affirmative "Yes". Then, the information processor 11 proceeds to step S204, and increments the counter "t" by one so as to indicate the next value of digital integral signal Sf(2). The information processor 11 compares the next value of digital integral signal Sf(2) with the value of threshold k to see whether or not the next value is equal to or greater than the value of threshold k as by step S205. If the next value of digital integral signal Sf(2) is equal to or greater than the value of threshold k, the answer at step S205 is given affirmative "Yes", and the information processor 11 returns to step S204.

In this way, the information processor 11 reiterates the loop consisting of steps S204 and S205 so as successively to compare the values of digital integral signal Sf(t) with the value of threshold k until the information processor 11 finds the value of digital integral signal Sf(t) less than the value of threshold k. When the information processor finds the digital integral signal Sf(t) firstly enter the numerical range less than the value of threshold k, the answer at step S205 is changed to negative "No", and the information processor changes the counter P to 1 as by step S206. The information processor 11 changes the counter P to 1 at step S206.

When the value of digital integral signal Sf(1) is less than the value of threshold k, the answer at step S203 is given negative "No", and the information processor 11 directly proceeds to step S206. The digital integral signal Sf(1) is the first one fallen within the numerical range less than the value of threshold k so that the information processor 11 changes the counter P to 1.

Subsequently, the information processor 11 proceeds to step S207, and increments the counter "t" by one. Upon completion of the job at step S207, the information processor 11 compares the next value of digital integral signal Sf(t) with the value of threshold k to see whether or not the next value is also less than the value of threshold k as by step S208. If the next value of digital integral signal Sf(t) returns to the numerical range equal to or greater than the value of threshold k, the answer at step S208 is given negative "No", and returns to step S204. Thus, the information processor 11 reiterates the loop consisting of steps S204, S205, S206, S207 and S208 in order to find two values of digital integral signal Sf(t) which are continuously found in the numerical range less than the value of threshold k.

When the information processor 11 finds the digital integral signal Sf(t) continuously remaining in the numerical range less than the value of threshold k, the answer at step S208 is given affirmative "Yes". With the positive answer "Yes", the information processor 11 increments the counter P by one as by step S209.

Subsequently, the information processor 11 checks the counter P to see whether or not the value stored in the counter P is equal to 3 as by step S210. If the information processor 11 merely finds the second value less than the value of threshold k, the counter P stores "2", and the answer at step S210 is given negative "No", and the information processor 11 returns to step S207, and increments the counter "t" by one at step S207. When the next value of digital integral signal Sf(t) is less than the value of threshold k, the digital integral signal Sf(t) continuously has three values less than the value of threshold k, and the information processor 11 changes the detecting signal d(t) to the active high level as by step S211.

However, if the next value of digital integral signal Sf(t) returns to the numerical range equal to or greater than the value of threshold k, the answer at step S208 is given negative "No", and the information processor 11 returns to step S204.

Thus, the information processor 11 reiterates the loop consisting of steps S204, S205, S206, S207, S208, S209 and S210 in order to find the digital integral signal Sf(t) having three values continuously remaining in the numerical range less than the value of threshold k.

When the information processor 11 completes the job at step S211, the information processor 11 checks the working memory to see whether or not there is any value of digital integral signal not processed, yet, as by step S212. If the answer at step S212 is given negative "No", the information processor 11 r3eturns to step S202. On the other hand, when the answer at step S212 is given affirmative "Yes", the information processor 11 completes the data processing.

Figure 5C:
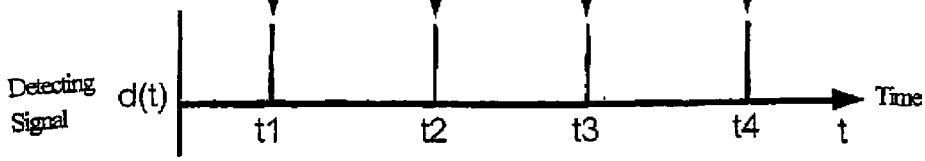
FIG. 5C is a graph showing a detecting signal.

The above-described behavior of comparator 120 is described with reference to FIGS. 5A to 5C. While the information processor 11 is reiterating the loop consisting of steps S202 to S212, the information processor 11 does not find any value of digital integral signal Sf(t) less than the value of threshold k due to the phrase modulation in the early stage of each modulation period T. The information processor 11 finds the first value of digital integral signal Sf(t) less than the value of threshold k in the data processing on the sample "a" and the third value of digital integral signal Sf(t) less than the value of threshold k in the data processing on sample "b". The information processor 11 changes the counter P to 1 in the data processing for sample "a", and the positive answer "Yes" at step S210 is given in the data processing for sample "b". For this reason, the information processor 11 produces the detecting signal d(t) at time t1 upon completion of job on sample "b" at step S210. Thus, the first detecting signal is produced at time t1 in FIG. 5C.

However, the counter P may not reach "3" in the data processing as shown in the second and third modulation periods 2T. In detail, although the value of digital integral signal Sf(t) becomes less than the value of threshold k in the data processing for sample "x" and sample "y" due to noise, the value of digital integral signal Sf(t) is recovered to the numerical range equal to or greater than the value of threshold k in the data processing on the next samples. The counter P does not proceeds to value "3", and the comparator 120 keeps the detecting signal d(t) inactive. For this reason, the discriminator can not confirm that the quasi audio signal Sg'(t) was produced through the 16 DPSK.

However, the value of digital integral signal Sf(t) firstly becomes less than the value of threshold k in the data processing on samples "c" and "e" in the second and third modulation periods 2T. The digital integral signal Sf(t) keeps the value less than the value of threshold k three times, and the detecting signal d(t) is changed to active after the data processing on samples "d" and "f" at time t2 and time t3.

In the modulation period next to the third one 2T, the value of digital integral signal Sf(t) firstly becomes less than the value of threshold k in the data processing on sample "g", and the counter P reaches 3 in the data processing on sample "h". For this reason, the detecting signal d(t) is changed to active at time t4.

Figure 7:
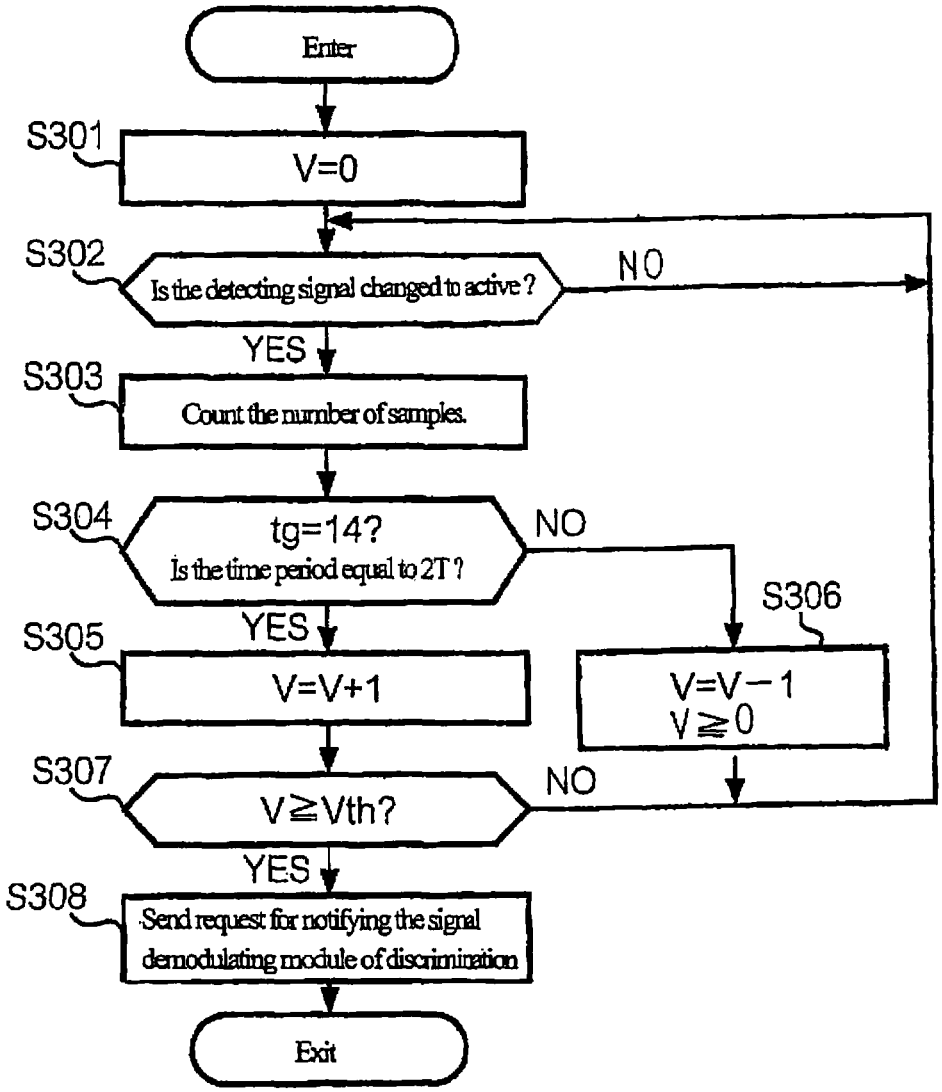
FIG. 7 is a flowchart showing another part of the subroutine program for music data code reproducer.

FIG. 7 shows another part of the subroutine program for music data code reproducer 20*a*, and the determiner 130 confirms the 16 DPSK through execution of the part of subroutine program shown in FIG. 7.

Upon entry into the part of subroutine program for music data code reproducer 20*a*, the information processor 11 resets the counter V to zero as by step S301. The counter V is indicative of the reliability of discrimination. The information processor 11 checks the working memory to see whether or not the detecting signal d(t) is changed to the active level as by step S302. Since the information processor 11 raises a flag upon change of the detecting signal d(t) to the active level, it is possible to determine whether or not the counter P reaches 3 by checking the flag. Upon completion of the job at step S302, the information processor 11 takes the flag down.

When the flag is firstly raised, the information processor 11 may repeat the job at step S302.

If the counter P holds 0, 1 or 2, the answer at step S302 is given negative "No", and the information processor 11 periodically repeats the job at step S302 until the answer at step S302 is given affirmative. When the counter P reaches 3, the answer at step S302 is changed to affirmative "Yes". Then, the information processor 11 specifies the sample at which the counter P reaches 3, and counts the number tg of samples until the sample at which the counter P previously reached 3. When the number tg is determined, the information processor 1 compares the number tg with 14 as by step S304. If the time period between the samples at which the counter P reaches zero is equal to the modulation period 2T, the number tg of samples is to be 14.

If the number tg is less than or greater than 14, the detecting signal d(t) is less reliable, and the answer at step S304 is given negative "No". With the negative answer, the information processor 11 decrements the counter V as by step S306. However, if the counter V is indicative of zero, the information processor 11 does not decrease the counter V. Thus, the least value of counter V is zero. Upon completion of the job at step S306, the information processor 11 returns to step S302.

On the other hand, if the number tg is equal to 14, the detecting signal d(t) is reliable, and the answer at step S304 is given affirmative "Yes". With the positive answer "Yes", the information processor 11 increments the counter V as by step S305.

Subsequently, the information processor 11 checks the counter V to see whether or not the discrimination is reliable as by step S307. The information processor 11 compares the value of counter V with a threshold Vth such as, for example, 3 at step S307. If the counter is indicative of the value less than the threshold Vth, the discrimination is less reliable, and the answer at step S307 is given negative "No". Then, the information processor 11 returns to step S302. When the counter V is indicative of a value equal to or greater than a threshold Vth such as 3, the discrimination is reliable, and the answer at step S307 is given positive "Yes". Then, the determiner 130 requests the informer 140 to give the signal demodulating module 20*i* of the discrimination of 16 DPSK as by step S308.

Thus, the information processor 11 reiterates the loop consisting of steps S302, S303, S304, S305, S306 and S307 until the discrimination becomes reliable.

Assuming now that the detecting signal d(t) is changed to active at time t1, time t2, time t3 and time t4, the determiner 130 sends the request for notifying the signal demodulating module 20*i* of the discrimination of 16 DPSK at time t4 under the condition that the number tg of samples are equal to 14 in the time periods between time t1 and time t2, time t2 and time t3 and time t3 and time t4.

In case where the phase is not changed in the early stage of modulation period 2T, the number tg of samples between the detecting signal and the previous detecting signal may be equal to 28. In this situation, although the counter V is decremented by one at step S306, the counter V is stepwise incremented after the decrement at step S306, and finally reaches the threshold Vth. Thus, the discriminator 130 surely keeps the request for notification reliable.

If the quasi audio signal Sg'(t) was not produced through the 16DPSK, the quasi audio signal Sg'(t) does not exhibit the particular feature of 16DPSK. Even if a series of samples resulted in the integrated value of zero, zero is not repeated over plural series of samples, and the detecting signal d(t) keeps itself inactive. On the other hand, if the modulation period is not equal to that of 16 DPSK, the detecting signal d(t) may be changed to active. However, the number of samples tg is different from the predetermined number, i.e., 14. As a result, the determiner 130 does not send the request for notifying the signal demodulating module 20*i* of the discrimination.

In case where another of the plural function sub-blocks 20*h*1 to 20*hn* discriminates a particular feature of another modulation technique, another function block notifies the signal demodulating module 20*i* of the discriminated modulation technique, and the signal demodulating module 20*i* recovers the continuous data stream from the quasi audio signal Sg'(t) through the corresponding demodulation technique.

As will be understood from the foregoing description, the function sub-block 20*h*0 discriminates the particular feature of 16DPSK, i.e., the time interval between the modulation periods is equal to 2T, and notifies the signal demodulating module 20*i* of the discrimination of 16DPSK. The other function sub-blocks similarly discriminates the particular features of other modulation techniques, and respectively notifies the signal demodulating module 20*i* of the discriminated modulation techniques. The notification from the sub-blocks is not concurrently produced together with the notification from other function sub-blocks. For this reason, the continuous data stream is surely recovered from the quasi audio signal Sg'(t).

Second Embodiment

Figure 8:
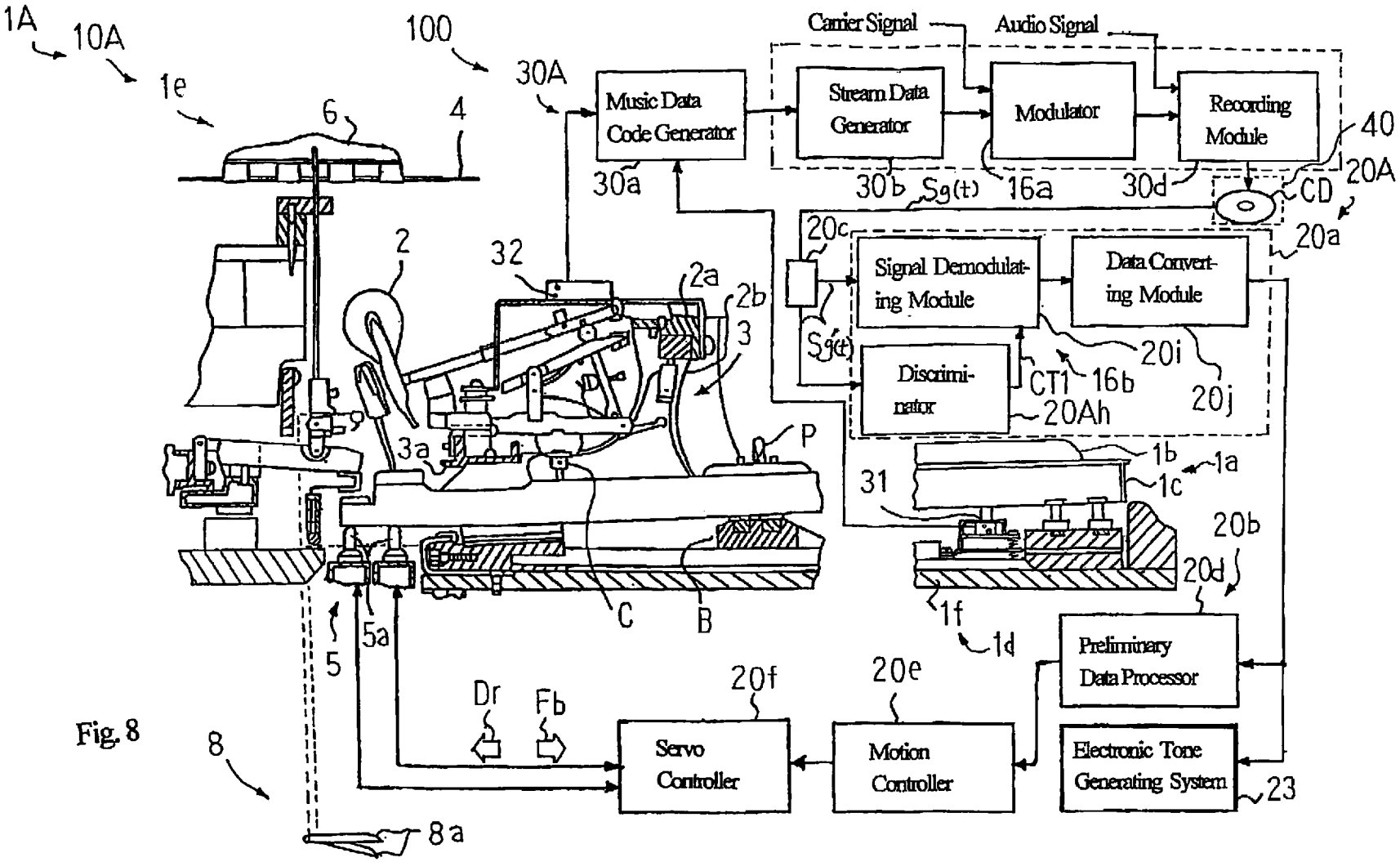
FIG. 8 is a view showing the structure of an acoustic piano, function blocks of a playback system and function blocks of a recording system incorporated in another automatic player piano of the present invention.

Turning to FIG. 8 of the drawings, another automatic player piano 1A largely comprises an acoustic piano 10A, a playback system 20A and a recording system 30A. The acoustic piano 10A and recording system 30A are similar to the acoustic piano 10 and recording system 30, and the playback system 20A is further similar to the playback system 20 except for a function sub-block 20Ah0 of a discriminator 20Ah. For this reason, the component parts of acoustic piano 10A, other component parts of playback system 20A and component parts of recording system 30A are labeled with references designating the corresponding component parts of acoustic piano 10, corresponding parts of playback system 20 and corresponding parts of recording system 30 without detailed description for avoiding repetition, and description is hereinafter focused on the discriminator 20Ah.

Figure 9:
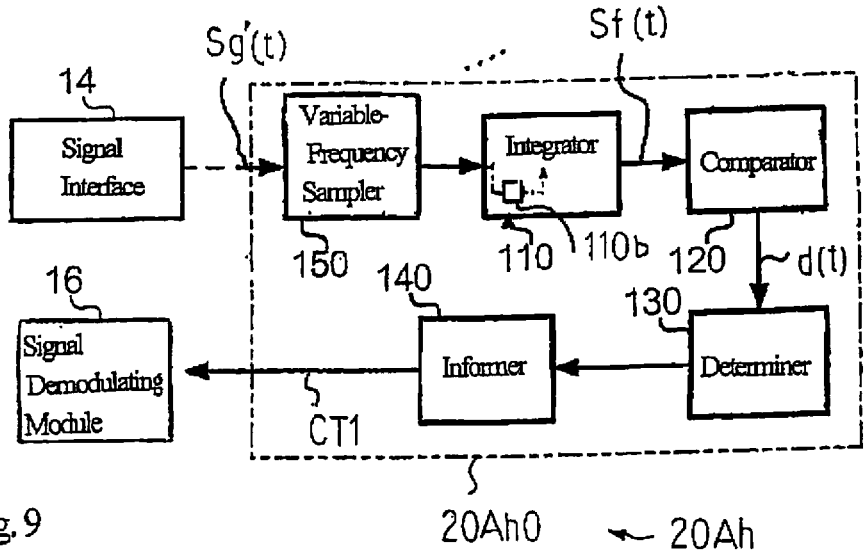
FIG. 9 is a block diagram showing the functions of a discriminator incorporated in the automatic player piano shown in FIG. 8.

The function sub-block 20Ah0 of discriminator 20Ah is illustrated in FIG. 9. The function sub-block 20Ah0 is equipped with a variable-frequency sampler 150 instead of the sample-and-hold circuit 110*a*. For this reason, other component blocks are labeled with references designating the corresponding component blocks of function block 20*h*0.

Although the sample-and-hold circuit 110*a*, the sampling frequency is fixed to 44.1 kHz, the variable-frequency sampler 150 can vary the frequency of sampling signal. The number of samples is not fixed to seven, and, accordingly. In order to obtain a predetermined natural number of samples from the quasi audio signal Sg'(t), the sampling frequency is to be adjusted to a frequency equal to the product of the carrier frequency T and the predetermined natural number. Of course, the predetermined number is to be not 1. If eight samples are to be extracted from the quasi audio signal Sg'(t) during each period T, the sampling frequency is adjusted to 50.4 kHz. The number tg of samples is to be sixteen.

The discriminator 20Ah achieves all the advantages of discriminator 20*h*. Moreover, the variable-frequency sampler 150 permits the integrator 110 to carry out the integration on an appropriate number of samples. This feature is desirable for unstable reproducers. In detail, if the disk driver 40 and digital-to-analog converter 20*c* are replaced with a cassette tape recorder/reproducer, the tape speed is unstable so that the period T of quasi audio signal Sg'(t) is varied together with the tape speed. In this situation, even if the integrated value once becomes zero, the integrated value of zero is less liable to be continued. As a result, the function sub-block 20*h*0 fails to discriminate the 16 DPSK. However, the function sub-block 20Ah0 of discriminator 20Ah can discriminate the particular feature of 16DPSK by changing the sampling frequency.

The discriminator 20Ah is desirable for a quasi audio signal with the modulation period different from 2T, because the sampling frequency is to be adjusted to a least common denominator of the carrier frequency and modulation frequency.

Figure 10:
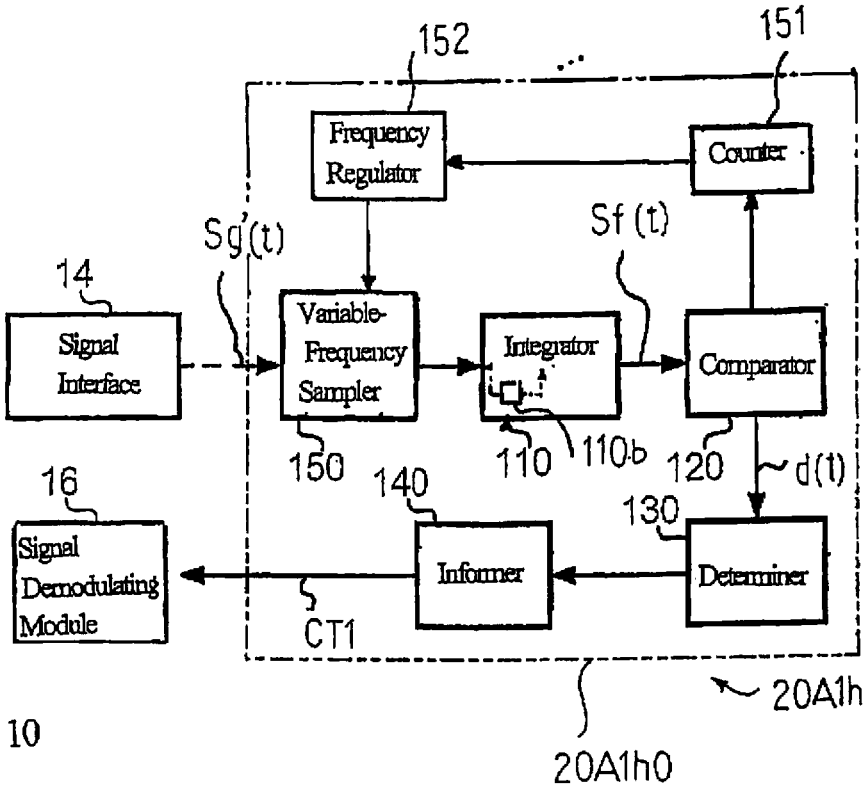
FIG. 10 is a block diagram showing the functions of a modification of the discriminator.

FIG. 10 shows a modification 20A1*h*0 of function sub-block 20Ah0. The function sub-block 20A1*h*0 forms a part of a discriminator 20A1*h*. The function sub-block 20A1*h*0 includes a counter 151 and a frequency regulator 152 in addition to the integrator 110, comparator 120, determiner 130, informer 140 and variable-frequency sampler 150. The counter 151 may be implemented by a register and a part of the subroutine program for music data code reproducer. The frequency regulator 152 may also implemented by another part of the subroutine program for music data code reproducer.

While the integrator 110 is supplying the digital integral signal Sf(t) to the comparator 120, the comparator 120 compares each of the values of digital signal Sf(t) with the value of threshold k to see whether or not the samples Sg(n) to Sg(n−6) expresses the non-modulated portion of quasi audio signal Sg'(t). In case where the answer is given negative at the step S210 three times due to the unstable tape speed, by way of example, the comparator 120 increments the counter 151 by one. If the counter 151 reaches a predetermined number, the counter 151 makes the frequency regulator 152 active. Then, the frequency regulator 152 starts to change the sampling frequency along a predetermined loop. For example, the frequency regulator 152 makes sampling frequency varied as if the carrier frequency is changed from 6.3 kHz through 6.2 kHz, 6.4 kHz, 6.1 kHz to 6.5 kHz. The sampling frequency is varied to 43.4 kHz for the carrier frequency of 6.2 kHz so that the seven samples are supplied to the integrator 110 in each period T. Because 6.2 kHz×7=43.4 kHz.

As will be understood from the foregoing description, the discriminators 20Ah and 20A1*h* can respond to a different value of the modulation period by virtue of the variable frequency sampler 150 in addition to the advantages of the discriminator 20*h*.

Third Embodiment

Figure 11:
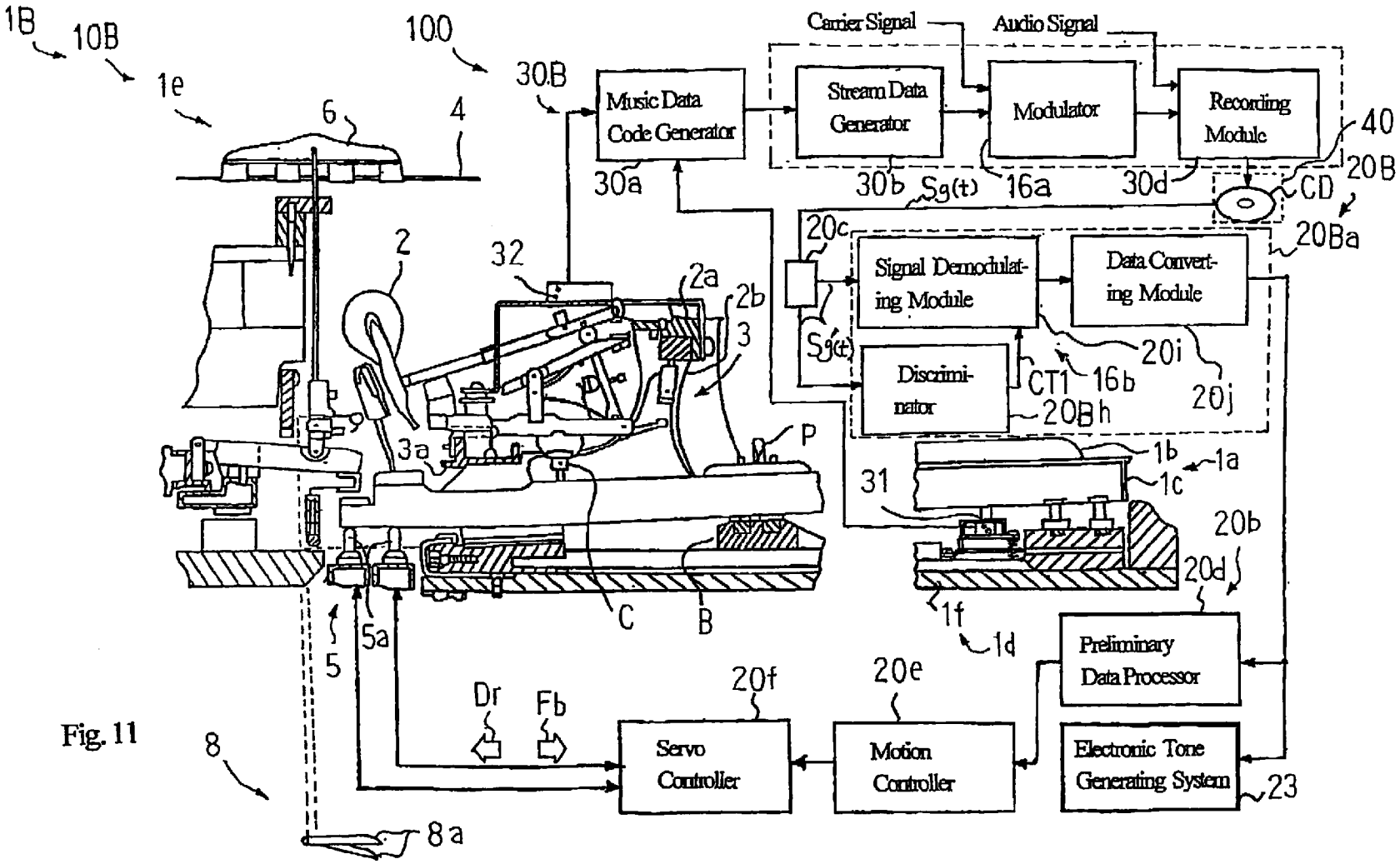
FIG. 11 is a view showing yet another automatic player piano of the present invention.

Turning to FIG. 11 of the drawings, yet another automatic player piano of the present invention largely comprises an acoustic piano 10B, a playback system 20B and a recording system 30B. The acoustic piano 10B and recording system 30B are similar to the acoustic piano 10 and recording system 30, and the playback system 20B is further similar to the playback system 20 except for a discriminator 20Bh. For this reason, the component parts of acoustic piano 10B, other component parts of playback system 20B and component parts of recording system 30B are labeled with references designating the corresponding component parts of acoustic piano 10, corresponding parts of playback system 20 and corresponding parts of recording system 30 without detailed description for avoiding repetition, and description is hereinafter focused on the discriminator 20Bh.

The discriminator 20Bh is different from the discriminator 20*h* in that the modulation technique employed in the quasi audio signal Sg'(t) is repeatedly examined, and, accordingly, the parts of subroutine programs for music data code reproducer 20Ba are periodically repeated. The fundamental function of discriminator 20Bh is similar to that of the discriminator 20*h*. For this reason, the terms "integrator", "comparator", "determiner" and "informer" are hereinafter referred to as the sub-functions of the discriminator 20Bh, and the "integrator", "comparator", "determiner" and "informer" are labeled with references 110B, 120B, 130B and 140B, respectively.

Figure 12:
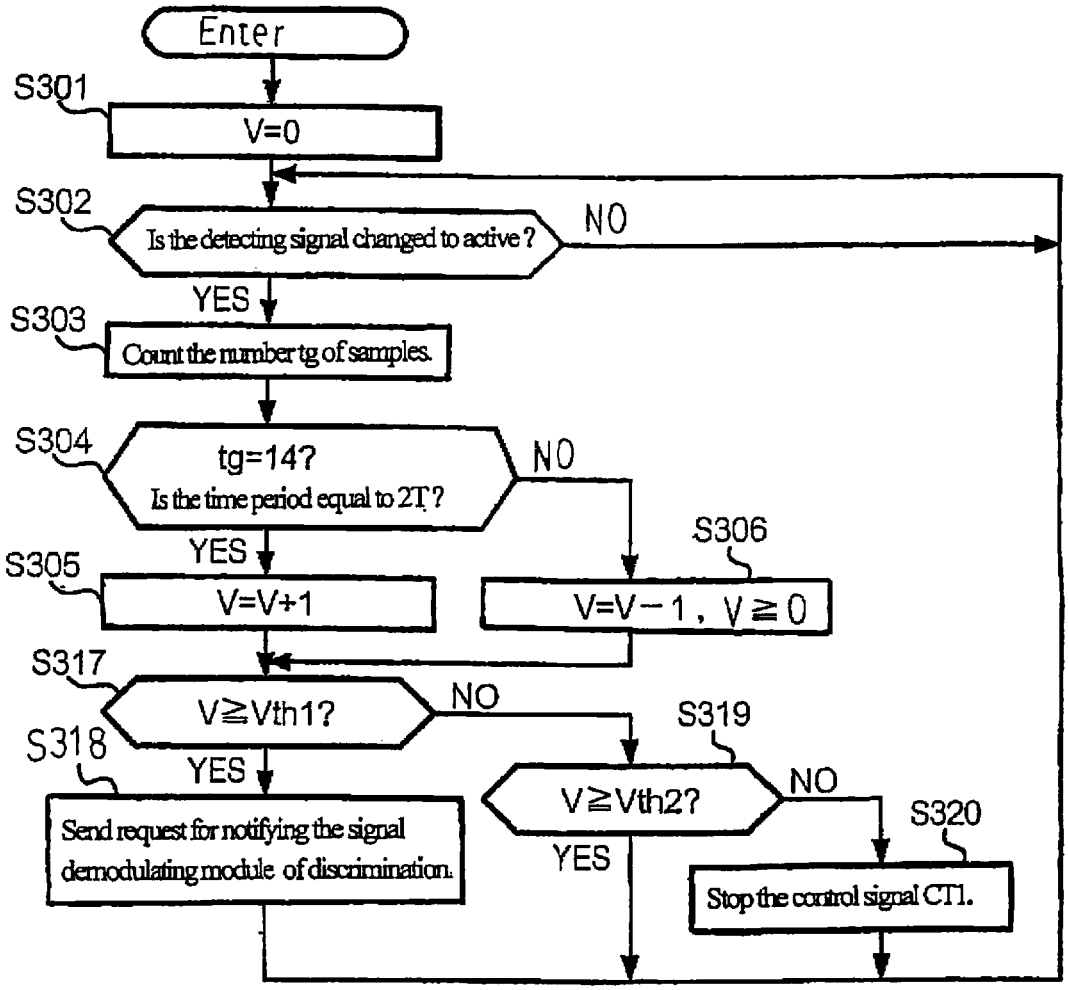
FIG. 12 is a flowchart showing a part of a subroutine program executed in the automatic player piano shown in FIG. 11.
Figure 13:
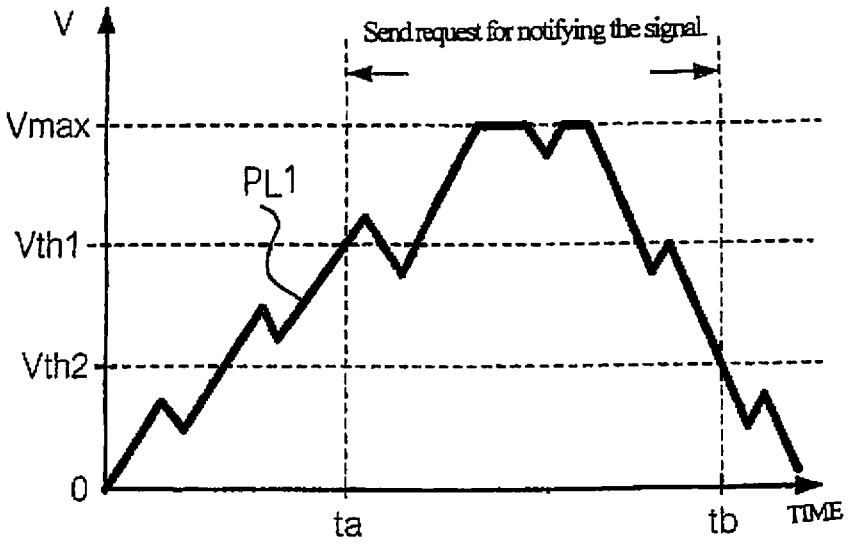
FIG. 13 is a graph showing the value held in a counter incorporated in the automatic player piano shown in FIG. 11.

FIG. 12 shows the jobs of determiner 130B. The integrator 110B continuously carries out the integration on groups of samples from the quasi audio signal Sg'(t). The comparator 120B continuously carries out the comparison whether or not the integrated value becomes less than the value of threshold k, and changes the detecting signal d(t) to the active level on the condition that the counter P reaches three. The jobs at steps S301, S302, S303, S304, S305 and S306 are same as those shown in FIG. 7, and, for this reason, description is not made on the jobs at the same steps S301 to S306. The determiner 130B has plural thresholds Vth1 and Vth2, and the counter V is changed between zero and Vmax as shown in FIG. 13. The threshold Vth1 is greater than the threshold Vth2. The counter V is not decremented below zero, and is not incremented over Vmax.

When the number of samples is equal to 14, i.e., the time period between the activations of detecting signal d(t) is equal to 2T, the answer at step S304 is given affirmative "YES". With the positive answer "YES", the information processor 11 increments the counter V by one as by step S305. On the other hand, if the time period between the activations of detecting signal d(t) is less than or greater than 2T, the answer at step S304 is given negative "NO", and the information processor 11 decrements the counter V by one as by step S306. Thus, the information processor 11 increments or decrements the counter V upon each activation of detecting signal d(t).

When the counter V is incremented or decremented at step S305 or S306, the information processor 11 compares the counter V with the threshold Vth1 so see whether or not the value in the counter V is equal to or greater than the value of threshold Vth1 as by step S317. When the time period equal to 2T is continued at least the predetermined times equal to the threshold Vth1, the answer is given affirmative "YES", and the determiner 130B requests the informer 140B to send the request for notifying the signal demodulating module 20*i* of the discrimination of 16DPSK. If the informer 140B has already sent the control signal CT1 representative of the discrimination of 16DPSK to the signal demodulating module 20*i*, the informer 140B continues to send the control signal CT1 to the signal demodulating module 20*i*.

However, if the answer at step S317 is given negative "NO", the information processor 11 compares the value of counter V with the threshold Vth2 to see whether or not the time period equal to 2T is equal to or at least greater than the threshold Vth2 as by step S319.

If the answer at step S319 is given affirmative "YES", the determiner 130B permits the informer 140B to keep the present status. If the informer 140B has supplied the control signal CT1, the determiner 130B permits the informer 140B to send the control signal CT1. On the other hand, if the informer 140B has stopped the control signal CT1, the determiner 130B requests the informer 140B to keep the control signal CT1 stopped.

On the other hand, if the answer at step S319 is given negative, the determiner 130B requests the informer 140B to stop the control signal CT1. If the informer 140B sends the control signal CT1, the informer 140B stops the control signal CT1. If the informer 140B has stopped the control signal CT1, the informer 140B keeps the control signal CT1 stopped.

Thus, the information processor 11 reiterates the loop consisting of steps S302, S303, S304, S305, S306, S317, S318, S319 and S320 for continuously monitoring the quasi audio signal Sg'(t) until the quasi audio data codes Sg(t) are not supplied from the disk driver 40 to the playback system 20B.

If the value of counter V is varied as indicated by plots PL1 in FIG. 13, the determiner 130B firstly sends the request for notifying the signal demodulating module 20*i* to the informer 140B at time ta, and the informer 140B continues to send the control signal CT1 representative of the discrimination of 16DPSK to the signal demodulating module 20*i* until the value of counter V is less than the threshold Vth2 at time tb.

The demodulator 20Bh achieves all the advantages of demodulator 20*h*. Moreover, even if a part of the quasi audio signal Sg'(t) was modulated through the 16DPSK, the discriminator 20Bh is responsive to the quasi audio signal Sg'(t) so as to make the continuous data stream from the quasi audio signal Sg'(t) through the appropriate demodulation technique. The threshold Vth1 may be equal to the threshold Vth2.

Although particular embodiments of the present invention have been shown and described, it will be apparent to those skilled in the art that various changes and modifications may be made without departing from the spirit and scope of the present invention.

The carrier frequency does not set any limit to the technical scope of the present invention. The carrier frequency of 16 DPSK may have a frequency less than or greater than 6.3 kHz. Moreover, the carrier signal in the audible frequency range does not set any limit to the technical scope of the present invention. The carrier signal may have the frequency of tens kHz in the ultra sonic frequency range.

The sin curve does not set any limit to the technical scope of the present invention. The carrier signal may have a cosign curve or waveforms of other periodic signals such as a periodic signal with a triangle waveform in so far as the waveform of carrier signal is symmetrical with the other half of the waveform with respect to the line indicative of the mid of potential range.

The modulation period 2T does not set any limit to the technical scope of the present invention. The modulation period may be less than two times, three times or more than three times longer than the period T of carrier signal in so far as the modulation period is longer than the period of carrier signal T. In case where the modulation period is greater than one and less than two, the number of sample groups, which produce the integrated value less than the value of threshold k, is reduced rather than the number of sample groups sampled from the quasi audio signal Sf(t) with the modulation period 2T. The information processor 11 changes the detecting signal d(t) to the active level at step S211 on the condition that the counter P reaches a certain value less than 3. The discriminator 20*h* is replaced with the discriminator 20Ah, and the sampling frequency is adjusted to a least common denominator of the carrier frequency and modulation frequency, i.e., the sampling frequency is adjusted to a multiple of the carrier frequency and a multiple of the modulation frequency. For example, in case where the modulation frequency is 4.2 kHz, the sampling frequency is adjusted to 50.4 kHz. However, if the modulation frequency is 4.41 kHz, the sampling frequency is not changed. When the quasi audio signal Sf(t) is sampled at 50.4 kHz, eight samples are obtained from each period T. If the number of samples is twelve, the counter V is incremented. As to the counter P, it is desirable to change the detecting signal to the active level on the condition that the counter P reaches a value equal to or less than the difference between twelve samples and eight samples, i.e., four. The value may be 2.

The detecting signal d(t) may be produced when two integrated values of zero or more than three integrated values of zero are continued.

The value of threshold Vth, i.e., three does not set any limit to the technical scope of the present invention. The discriminator 130 may notify the signal modulating module 20*i* on the condition that the counter V reaches 1, 2 or more than 3.

The control signal CT1 may serve as a strobe signal applied to the demodulator of 16 DPSK in the signal demodulating module 20*i*.

The time period between the activations of detecting signal d(t) may be determined through a method different from the method for counting the samples. For example, it is possible to determine the time period between the activations of detecting signal d(t) through an FFT (Fast Fourier Transform). Thus, the job at step S303 does not set any limit to the technical scope of the present invention.

The automatic player pianos 1, 1A and 1B do not set any limit to the technical scope of the present invention. The present invention may appertain to an electronic keyboard, a mute piano, another sort of electronic musical instrument such as, for example, an electronic wind musical instrument, another sort of automatic player musical instrument such as, for example, an automatic string musical instrument or a sound recorder and reproducer.

The computer program, in which the subroutine program for music data code reproducer contains, may be offered to users in the form of a magnetic disk, an optical disk, an optomagnetic disk or portable semiconductor memory devices. Moreover, the computer program may be downloaded through a communication network such as the internet.

The value "3" at step S210 does not set any limit to the technical scope of the present invention. The value may be greater than zero and less than 3 or greater than 3.

The component parts and job steps of the embodiments are correlated with claim languages as follows. The automatic player pianos 1, 1A and 1B is corresponding to "a musical instrument", and the demodulator 16*b* is corresponding to "a signal modulator". The MIDI music data codes form "a signal" and "a music signal", and the quasi audio signal Sg'(t) serve as "a modulated signal". The 16DPSK or 2FSK is corresponding to "a modulation technique", and the discriminators 20*h*, 20Ah and 20A1*h* is corresponding to "a discriminator". The 16 DPSK is "a predetermined modulation technique". The modulation period 2T is corresponding to "a modulation period". The early stage of quasi audio signal Sg'(t) is corresponding to "a modulated section", and the latter stage of quasi audio signal Sg'(t) is corresponding to "a non-modulated section." The information processor 11 serves as "an information processor", and a sampling-and-hold circuit 110*a* and variable-frequency sampler 150 serve as "a sampler". The samples Sg(n) to Sg(n−6) as a whole constitute "a group of samples". The subroutine program for music data code reproducer serves as "a computer program".

The information processor 11 and jobs at steps S202, S203, S204, S205, S206, S207, S208, S209, S210 and S211 realize "a detector", and the integrator 110 and comparator 120 as a whole constitute the "detector". The information processor 11 and jobs at steps S302, S303 and S304 realize "a measurer", and the information processor 11 and jobs at steps S305, S306, S307 and S308 realize "a determiner", and the information processor 11 and jobs at steps S305, S306, S317, S318, S319 and S320 also realize the "determiner". The 16 DPSK is corresponding to "a predetermined modulation technique", and the signal demodulating module 16 is corresponding to "a signal demodulating module".

The automatic player 20*b* or electronic tone generating system 23 serves as "a tone generator".

The integrator 110 is corresponding to "an integrator", and the comparator 120 is corresponding to "a comparator". The samples Sg(n), . . . Sg(n−6) are corresponding to "a predetermined number of samples", and zero is "a predetermined value". The register 110*a* is corresponding to "a register", and the threshold k is corresponding to "a threshold value".

The variable frequency sampler 150 is corresponding to "a variable frequency sampler". The counter 151 is corresponding to "a counter", and the frequency regulator 152 is corresponding to "a frequency regulator". The predetermined number for the counter 152 is corresponding to "a critical number".

The information processor 11 and jobs at steps S305 and S306 realizes "a status register", and the threshold Vth1 and threshold Vth2 serve as "a first threshold" and "a second threshold".

What is claimed is:

1. A discriminator of a modulation technique through which a carrier signal is modulated to a modulated signal, said modulated signal being dividable into plural portions each equal in time period to a modulation period, each of said plural portions having a modulated section subjected to a modulation through said modulation technique and followed by a non-modulated section, said discriminator comprising:

an information processor having information processing capability; and a sampler extracting discrete values from a waveform of said modulated signal so as to produce a series of samples expressing said discrete values, and supplying said series of samples to said information processor, a computer program running on said information processor so as to realize a detector supplied with said series of samples from said sampler, and specifying groups of samples expressing the non-modulated sections in said plural portions, a measurer supplied with said groups of samples from said detector, and determining a time period between the group of samples in one of said plural portions and the group of samples in another of said plural portions next to said one of said plural portions and a determiner determining that said modulation technique is same as a predetermined modulation technique when said time period is equal to said modulation period.

2. The discriminator as set forth in claim 1, in which said detector includes an integrator repeatedly carrying out an integration on said series of samples so as to determine an integrated value of a predetermined number of samples, and a comparator comparing said integrated value with a predetermined value unique to said non-modulated section to see whether or not said integrated value is equal to said predetermined value and determining said predetermined number of samples as the group of samples on the condition that said integrated value is equal to said predetermined value.

3. The discriminator as set forth in claim 2, in which said detector further includes a register for storing a threshold value defining a neighborhood of said predetermined value, and said comparator deems that the integrated value is equal to said predetermined value if the integrated value is fallen within said neighborhood.

4. The discriminator as set forth in claim 2, in which said predetermined number for said samples is equal to a quotient given by dividing the frequency of a sampling signal used in said sampler by a frequency of said carrier signal.

5. The discriminator as set forth in claim 4, in which said sampler is a variable-frequency sampler capable of changing said sampling frequency so that said predetermined number for said samples is varied together with said frequency of said sampling signal.

6. The discriminator as set forth in claim 5, in which said computer program further realizes a counter monitoring said detector so as to count a number of failure in specifying the group of samples, and a frequency regulator supplied with said number of failure from said counter and changing said frequency of said sampling signal when said number reaches a critical number.

7. The discriminator as set forth in claim 1, in which said computer program is repeated after the determination of equality between said modulation technique and said predetermined modulation technique made by said determiner, and said computer program further realizes a status register incremented at the equality between said time period and said modulation period and decremented at a failure in determination of equality between said time period and said modulation period, whereby said determiner determines that said modulation technique is same as said predetermined modulation technique on the condition that said status register is equal to or greater than a first threshold and that said modulation technique is uncertain on the condition that said status register is less than a second threshold.

8. The discriminator as set forth in claim 1, in which said modulated signal has a frequency fallen within an audible frequency range.

9. The discriminator as set forth in claim 1, in which said predetermined modulation technique is 16 differential phase shift keying.

10. A signal demodulator for reproducing a signal from a modulated signal, a carrier signal being modulated to said modulated signal with said signal through a modulation technique, comprising:

a discriminator supplied with said modulated signal dividable into plural portions each equal in time period to a modulation period, each of said plural portions having a modulated section subjected to a modulation through said modulation technique and followed by a non-modulated section, and including an information processor having information processing capability and a sampler extracting discrete values from a waveform of said modulated signal so as to produce a series of samples expressing said discrete values and supplying said series of samples to said information processor, a computer program running on said information processor so as to realize a detector supplied with said series of samples from said sampler, and specifying groups of samples expressing the non-modulated sections in said plural portions, a measurer supplied with said groups of samples from said detector, and determining a time period between the group of samples in one of said plural portions and the group of samples in another of said plural portions next to said one of said plural portions and a determiner determining that said modulation technique is same as a predetermined modulation technique when said time period is equal to said modulation period; and a signal demodulating module connected to said discriminator, and supplied with said modulated signal so as to demodulate said modulated signal to said signal through a demodulating technique corresponding to said predetermined modulation technique when said determiner determines that said modulation technique is same as said predetermined modulation technique.

11. The signal demodulator as set forth in claim 10, in which said detector includes an integrator repeatedly carrying out an integration on said series of samples so as to determine an integrated value of a predetermined number of samples, and a comparator comparing said integrated value with a predetermined value unique to said non-modulated section to see whether or not said integrated value is equal to said predetermined value and determining said predetermined number of samples as the group of samples on the condition that said integrated value is equal to said predetermined value.

12. The signal demodulator as set forth in claim 11, in which said detector further includes a register for storing a threshold value defining a neighborhood of said predetermined value, and said comparator deems that the integrated value is equal to said predetermined value if the integrated value is fallen within said neighborhood.

13. The signal demodulator as set forth in claim 10, said sampler is a variable-frequency sampler capable of changing a frequency of a sampling signal so that said predetermined number for said samples is varied together with said frequency of said sampling signal.

14. The signal demodulator as set forth in claim 13, in which said computer program further realizes a counter monitoring said detector so as to count a number of failure in specifying the group of samples, and a frequency regulator supplied with said number of failure from said counter and changing said frequency of said sampling signal when said number reaches a critical number.

15. The signal demodulator as set forth in claim 10, in which said computer program is repeated after the determination of equality between said modulation technique and said predetermined modulation technique made by said determiner, and said computer program further realizes a status register incremented at the equality between said time period and said modulation period and decremented at a failure in determination of equality between said time period and said modulation period, whereby said determiner determines that said modulation technique is same as said predetermined modulation technique on the condition that said status register is equal to or greater than a first threshold and that said modulation technique is uncertain on the condition that said status register is less than a second threshold.

16. A musical instrument for producing tones, comprising:

a signal demodulator for reproducing a music signal expressing tones to be produced from a modulated signal, a carrier signal being modulated to said modulated signal with said music signal through a modulation technique, and including a discriminator supplied with said modulated signal dividable into plural portions each equal in time period to a modulation period, each of said plural portions having a modulated section subjected to a modulation through said modulation technique and followed by a non-modulated section, and having an information processor having information processing capability and a sampler extracting discrete values from a waveform of said modulated signal so as to produce a series of samples expressing said discrete values and supplying said series of samples to said information processor, a computer program running on said information processor so as to realize a detector supplied with said series of samples from said sampler, and specifying groups of samples expressing the non-modulated sections in said plural portions, a measurer supplied with said groups of samples from said detector, and determining a time period between the group of samples in one of said plural portions and the group of samples in another of said plural portions next to said one of said plural portions and a determiner determining that said modulation technique is same as a predetermined modulation technique when said time period is equal to said modulation period and a signal demodulating module connected to said discriminator, and supplied with said modulated signal so as to demodulate said modulated signal to said music signal through a demodulating technique corresponding to said predetermined modulation technique when said determiner determines that said modulation technique is same as said predetermined modulation technique; and a tone generator connected to said signal modulator, and supplied with said music signal so as to produce said tones on the basis of said music signal.

17. The musical instrument as set forth in claim 16, in which said detector includes an integrator repeatedly carrying out an integration on said series of samples so as to determine an integrated value of a predetermined number of samples, and a comparator comparing said integrated value with a predetermined value unique to said non-modulated section to see whether or not said integrated value is equal to said predetermined value and determining said predetermined number of samples as the group of samples on the condition that said integrated value is equal to said predetermined value.

18. The musical instrument as set forth in claim 16, in which said detector further includes a register for storing a threshold value defining a neighborhood of said predetermined value, and said comparator deems that the integrated value is equal to said predetermined value if the integrated value is fallen within said neighborhood.

19. The musical instrument as set forth in claim 16, in which said tone generator serves as an automatic player.

20. A method of discriminating a modulation technique through which a signal is modulated to a modulated signal dividable into plural portions each equal in time period to a modulation period, each of said plural portions having a modulated section subjected to a modulation through said modulation technique and followed by a non-modulated section, comprising the steps of:

a) extracting discrete values from a waveform of said modulated signal so as to produce a series of samples expressing said discrete values;

b) specifying groups of samples expressing the non-modulated sections in said plural portions;

c) determining a time period between the group of samples in one of said plural portions and the group of samples in another of said plural portions next to said one of said plural portions; and d) determining that said modulation technique is same as a predetermined modulation technique when said time period is equal to said modulation period.

* * * * *